US011858708B2

(12) United States Patent
Otsuka et al.

(10) Patent No.: US 11,858,708 B2
(45) Date of Patent: Jan. 2, 2024

(54) SHEET MEMBER CONTAINER

(71) Applicant: Kao Corporation, Tokyo (JP)

(72) Inventors: Takahiro Otsuka, Sumida-ku (JP); Daisuke Kodama, Sumida-ku (JP); Akira Kuragano, Sumida-ku (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 17/906,120

(22) PCT Filed: Mar. 13, 2020

(86) PCT No.: PCT/JP2020/011229
§ 371 (c)(1),
(2) Date: Sep. 12, 2022

(87) PCT Pub. No.: WO2021/181691
PCT Pub. Date: Sep. 16, 2021

(65) Prior Publication Data
US 2023/0150743 A1 May 18, 2023

(51) Int. Cl.
*B65D 75/38* (2006.01)
*B65D 75/00* (2006.01)
*B65D 75/58* (2006.01)

(52) U.S. Cl.
CPC ..... *B65D 75/38* (2013.01); *B65D 75/008* (2013.01); *B65D 75/5872* (2013.01)

(58) Field of Classification Search
CPC .. B65D 75/38; B65D 75/008; B65D 75/5872; B65D 75/52; B65D 77/04; B65D 33/02
USPC ..... 383/109
See application file for complete search history.

(56) References Cited

U.S. PATENT DOCUMENTS 5,174,458 A * 12/1992 Segati ..... B65D 1/0292 220/666
5,261,881 A * 11/1993 Riner ..... A61M 5/282 604/110
6,176,613 B1 * 1/2001 Chen ..... B65D 33/00 383/18
6,607,097 B2 * 8/2003 Savage ..... B65D 75/5877 220/62.12

(Continued)

FOREIGN PATENT DOCUMENTS

EP 3593984 A1 1/2020
JP 2006-240651 A 9/2006

(Continued)

OTHER PUBLICATIONS

International Search Report with partial English translation dated Apr. 21, 2020 in PCT/JP2020/011229 filed on Mar. 13, 2020 (5 pages).

(Continued)

*Primary Examiner* — Peter N Helvey
(74) *Attorney, Agent, or Firm* — Oblon, McClelland, Maier & Neustadt, L.L.P.

(57) ABSTRACT

A sheet member container including one or more sheet members, including a main-body forming sheet member having an outer film layer and an inner film layer laminated on each other. The sheet member container has a containing portion that accommodates contents, a container main body including the main-body forming sheet member, and a peripheral edge sealing portion in which the one or more sheet members are folded along a folding line.

20 Claims, 22 Drawing Sheets

(56) References Cited

U.S. PATENT DOCUMENTS 6,673,301 B2 * 1/2004 Cargile ..... B65D 35/08 222/206
8,206,033 B2 * 6/2012 Sato ..... B29C 66/133 383/906
8,960,183 B2 * 2/2015 Husson, Jr. ..... C02F 1/001 220/592.01
D753,995 S * 4/2016 Sanfilippo ..... D9/433
9,327,867 B2 * 5/2016 Stanley ..... B65D 75/008
10,457,457 B2 * 10/2019 Arent ..... B65D 85/70
2008/0149666 A1 * 6/2008 LaFlamme ..... B65D 75/5872 222/105
2013/0248540 A1 * 9/2013 Darby ..... B65D 75/5877 229/5.5
2014/0033655 A1 * 2/2014 Stanley ..... B65B 3/04 53/456
2015/0034670 A1 * 2/2015 Stanley ..... B65D 77/28 222/105
2015/0121810 A1 * 5/2015 Bourgeois ..... B65B 9/2049 53/434
2015/0122373 A1 * 5/2015 Bourgeois ..... B65D 33/02 141/12
2015/0122840 A1 * 5/2015 Cox ..... B65D 75/20 222/213
2015/0122841 A1 * 5/2015 McGuire ..... B65D 81/03 222/206
2015/0122846 A1 * 5/2015 Stanley ..... B65D 75/5877 222/206
2016/0176578 A1 * 6/2016 Stanley ..... B65D 35/02 206/459.5
2016/0176582 A1 * 6/2016 McGuire ..... B65D 35/24 206/277
2016/0176583 A1 * 6/2016 Ishihara ..... B65D 75/008 53/452
2016/0176584 A1 * 6/2016 Ishihara ..... B65D 35/02 493/243
2016/0176597 A1 * 6/2016 Ishihara ..... B31B 70/00 493/243
2016/0221727 A1 * 8/2016 Stanley ..... B65D 75/525
2016/0297569 A1 * 10/2016 Berg, Jr. ..... B65D 75/5811
2016/0297590 A1 * 10/2016 You ..... B05B 11/026
2016/0297591 A1 * 10/2016 You ..... B05B 11/026
2016/0325518 A1 * 11/2016 Ishihara ..... B31B 50/00
2016/0362228 A1 * 12/2016 McGuire ..... B05B 11/026
2017/0001782 A1 * 1/2017 Arent ..... B65D 75/008
2019/0168941 A1 6/2019 Otsuka et al.
2019/0185213 A1 6/2019 Kodama et al.
2019/0248546 A1 8/2019 Inagawa et al.
2021/0163181 A1 * 6/2021 Kodama ..... B65D 75/008
2021/0339929 A1 * 11/2021 Otsuka ..... B32B 7/06
2022/0033161 A1 * 2/2022 Shibutani ..... B32B 7/12
2022/0281668 A1 * 9/2022 Bloedt ..... B67D 3/0061
2022/0324624 A1 * 10/2022 Kodama ..... B65D 75/5866
2023/0072263 A1 * 3/2023 Takano ..... B65D 75/5877
2023/0108758 A1 * 4/2023 Shiba ..... B05B 11/026 383/109
2023/0174282 A1 * 6/2023 Takano ..... B31B 70/81 383/3
2023/0211576 A1 * 7/2023 Ferracane ..... B65D 21/08 428/35.7

FOREIGN PATENT DOCUMENTS

JP 2016-535708 A 11/2016
JP 6153185 B1 6/2017
JP 2018108843 A 7/2018
JP 2018144886 A 9/2018
JP 2018144887 A 9/2018
JP 2018144888 A 9/2018
JP 2019202789 A 12/2019
JP 2019214398 A 12/2019
WO WO 2018/163269 A1 9/2018

OTHER PUBLICATIONS

Office Action mailed in CN patent application No. 202080098430.5 dated Aug. 14, 2023 (with English machine translation).
Extended European Search Report has been issued for the corresponding EP Patent Application No. 20924591.9 dated Nov. 6, 2023.

* cited by examiner

SHEET MEMBER CONTAINER

CROSS-REFERENCE TO RELATED APPLICATIONS

The present application is a 35 U.S.C. § 371 national stage application of International patent application PCT/JP2020/011229, filed Mar. 13, 2020. The entire content of this application is incorporated herein by reference.

TECHNICAL FIELD

The present invention relates to a sheet member container.

BACKGROUND ART

A sheet member container having a structure in which a plurality of film layers are laminated and a filler such as air is enclosed between the layers to form a filling portion is described, for example, in Patent Document 1. The filling portion of the sheet member container of Patent Document 1 is arranged across a first surface portion (a body portion) and a second surface portion (a bottom portion).

Related Art Document

Patent Document 1: Japanese Patent No. 6153185

SUMMARY OF THE INVENTION

The present invention relates to a sheet member container including one or a plurality of sheet members including a main-body forming sheet member including an outer film layer and an inner film layer laminated on each other, wherein the sheet member container further includes a containing portion that accommodates contents, and a container main body including the main-body forming sheet member, and surrounding the containing portion, the main-body forming sheet member includes a main-body sealing portion that is an attached portion of the outer film layer and the inner film layer, and a non-attached region in which the outer film layer and the inner film layer are partially not attached, and includes a filling portion in which a filler can be enclosed between layers of the outer film layer and the inner film layer in the non-attached region, the sheet member container further includes a peripheral edge sealing portion in which the one or plurality of sheet members are folded along a folding line, and portions in a peripheral edge portion of at least an innermost layer sheet member of the one or plurality of sheet members are attached to each other, the containing portion is defined by the peripheral edge sealing portion, the container main body includes a plurality of surface portions, the plurality of surface portions include a first surface portion and a second surface portion that are adjacent to each other, the filling portion includes an interfacial connecting portion arranged across the first surface portion and the second surface portion via a boundary between the first surface portion and the second surface portion, and in the boundary, an end portion of the peripheral edge sealing portion along the folding line is away from a boundary position between the interfacial connecting portion and the main-body sealing portion.

DESCRIPTION OF EMBODIMENTS

Figure 1:
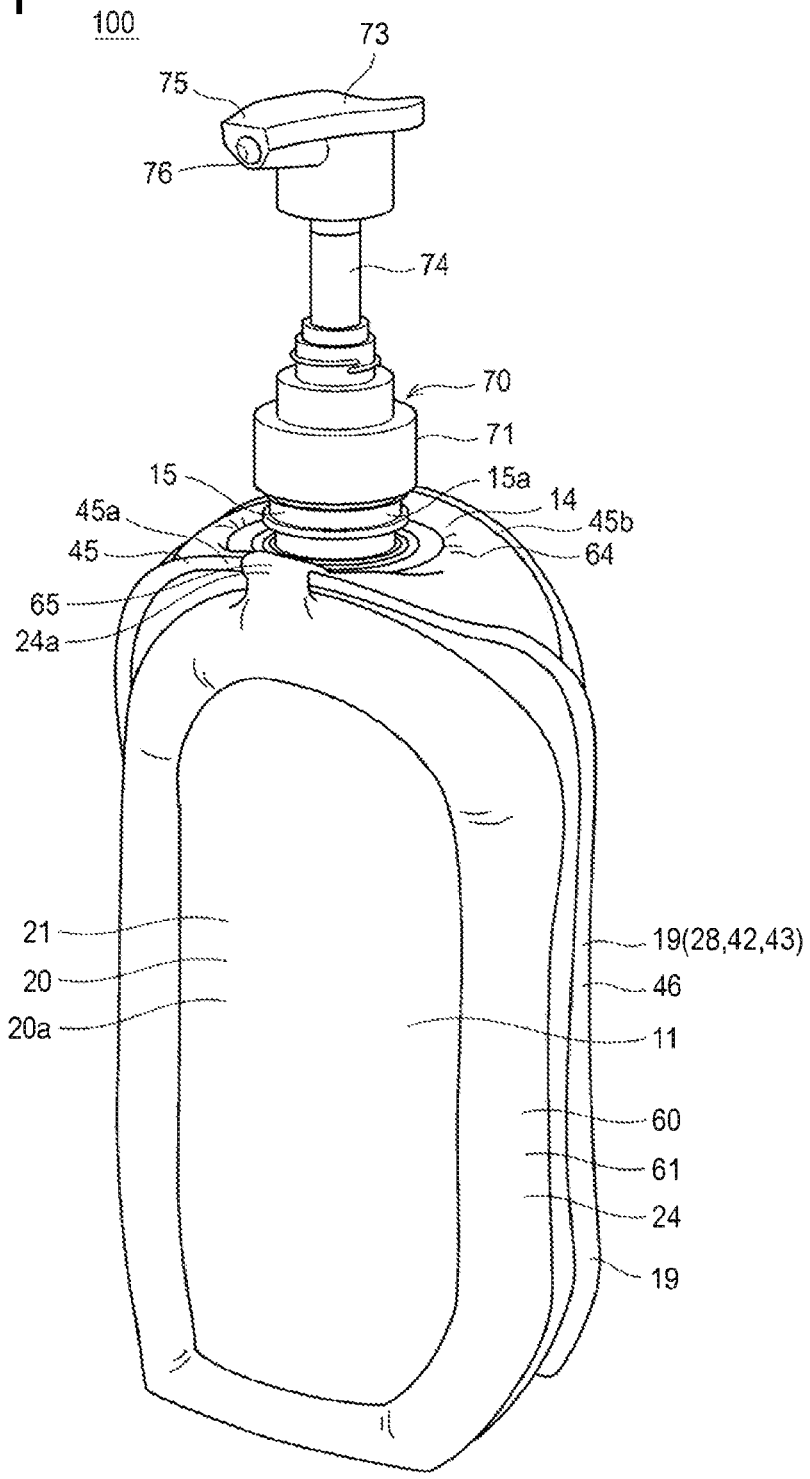
FIG. 1 is a perspective view illustrating a state where a filler is enclosed in a sheet member container according to a first exemplary embodiment.

According to investigation by the present inventor, there is still room for improvement in terms of fillability of a filling portion with a filler in a sheet member container of Patent Document 1.

The present invention relates to a sheet member container including a structure with excellent fillability of a filling portion with a filler.

Below, preferable exemplary embodiments according to the present invention will be described with reference to the drawings. Note that, in all the drawings, the same reference characters are attached to similar constituent components, and detailed explanation thereof will not be repeated.

First Exemplary Embodiment

First, a first exemplary embodiment will be described with reference to FIG. 1 to FIG. 12. In the drawings, FIG. 1 to FIG. 7 illustrate a sheet member container 100 in a state where a filler is enclosed.

Figure 7:
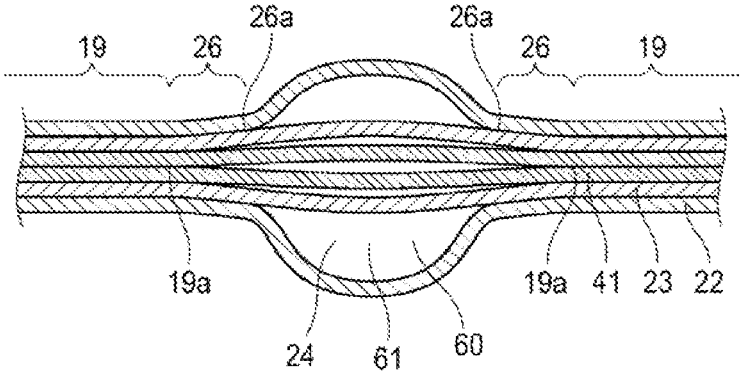
FIG. 7 is a cross-sectional view taken along the A-A line in FIG. 6.
Figure 11:
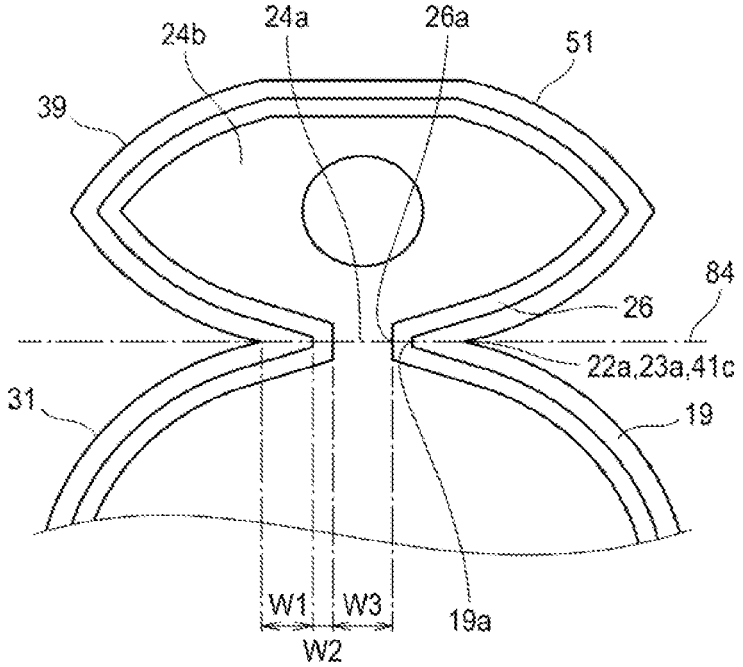
FIG. 11 is a partially enlarged view of the container forming sheet member.
Figure 12:
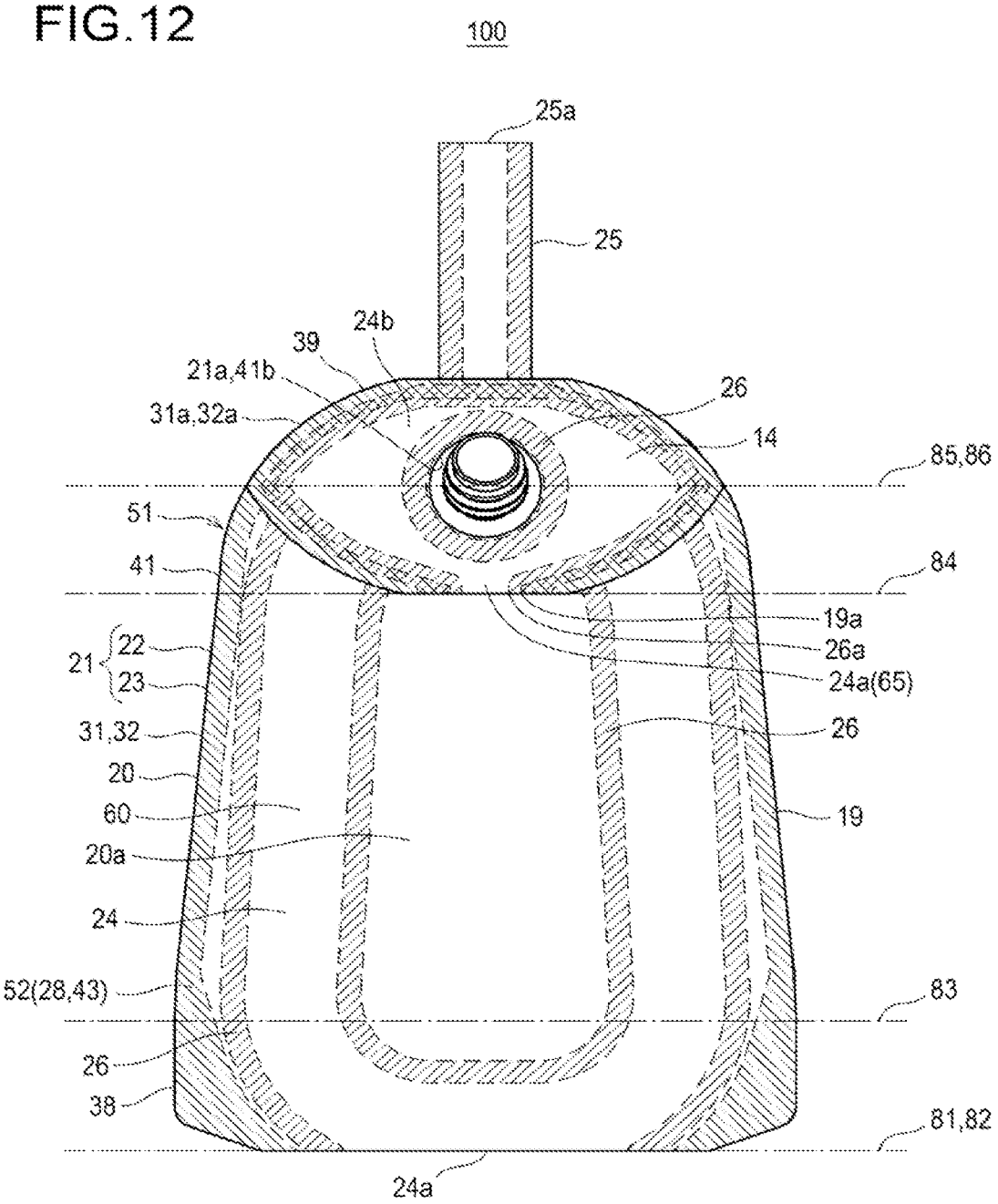
FIG. 12 is a perspective view illustrating the sheet member container according to the first exemplary embodiment, and illustrating a state before the filler is enclosed.

The sheet member container 100 according to this exemplary embodiment is the sheet member container 100 including one or a plurality of sheet members including a main-body forming sheet member 21 including an outer film layer 22 and an inner film layer 23 laminated on each other, and includes a containing portion 17 that stores contents 18, and a container main body 20 including the main-body forming sheet member 21 and surrounding the containing portion 17. The main-body forming sheet member 21 includes a main-body sealing portion 26 (FIG. 7, FIG. 9, and the like) that is an attached portion of the outer film layer 22 and the inner film layer 23, and a non-attached region 24 in which the outer film layer 22 and the inner film layer 23 are partially not attached, and includes a filling portion 60 in which the filler can be enclosed between layers of the outer film layer 22 and the inner film layer 23 in the non-attached region 24. The sheet member container 100 includes a peripheral edge sealing portion 19 in which one or a plurality of sheet members are folded along folding lines 81, 82, 83, 84, 85 and 86 (FIG. 10 and FIG. 12), and in which portions in a peripheral edge portion of at least an innermost layer sheet member (in a case of this exemplary embodiment, an inner-bag forming sheet member 41) of the one or plurality of sheet members are attached to each other. The containing portion 17 is defined by the peripheral edge sealing portion 19. The container main body 20 includes a plurality of surface portions, and the plurality of surface portions include a first surface portion (in the case of this exemplary embodiment, a first main surface portion 20*a*) and a second surface portion (in the case of this exemplary embodiment, a top gusset portion 14) that are adjacent to each other. The filling portion 60 includes an interfacial connecting portion 65 arranged across the first surface portion and the second surface portion via a boundary between the first surface portion and the second surface portion. As illustrated in FIG. 7, FIG. 11 and FIG. 12, in the boundary between the first surface portion and the second surface portion, an end portion 19*a* of the peripheral edge sealing portion 19 along the folding line 84 is away from a boundary position 26*a* between the interfacial connecting portion 65 and the main body sealing portion 26.

According to this exemplary embodiment, in the boundary between the first surface portion and the second surface portion, the end portion 19*a* of the peripheral edge sealing portion 19 along the folding line 84 is away from the boundary position 26*a* between the interfacial connecting portion 65 and the main-body sealing portion 26. Consequently, the boundary between the first surface portion and the second surface portion has a structure in which film layers that constitute the sheet member container 100 are peeling off each other also in a region on an outer side of the interfacial connecting portion 65 (a region from the end portion 19*a* of the peripheral edge sealing portion 19 to the boundary position 26*a* between the interfacial connecting portion 65 and the main-body sealing portion 26). Consequently, movement of the outer film layer 22 and the inner film layer 23 that constitute the interfacial connecting portion 65 (non-attached region 24) is hard to be regulated, and a space between the layers of the outer film layer 22 and the inner film layer 23 (a space in the non-attached region 24) is easily acquired. Therefore, when the filling portion 60 is filled with the filler in a folded state along the folding line 84, the filler can easily flow between the filling portion 60 of the first surface portion and the filling portion 60 of the second surface portion. For example, firstly the filling portion 60 of the first surface portion and then the filling portion 60 of the second surface portion can be easily filled with the filler through the interfacial connecting portion 65. That is, the sheet member container 100 having the structure excellent in fillability of the filling portion 60 with the filler can be provided.

In the case of this exemplary embodiment, the sheet member container 100 includes a bottom gusset portion 13 (FIG. 2 and FIG. 4) as a bottom portion, and can stand independently in a state where the bottom gusset portion 13 is mounted on a horizontal mounting surface.

Figure 2:
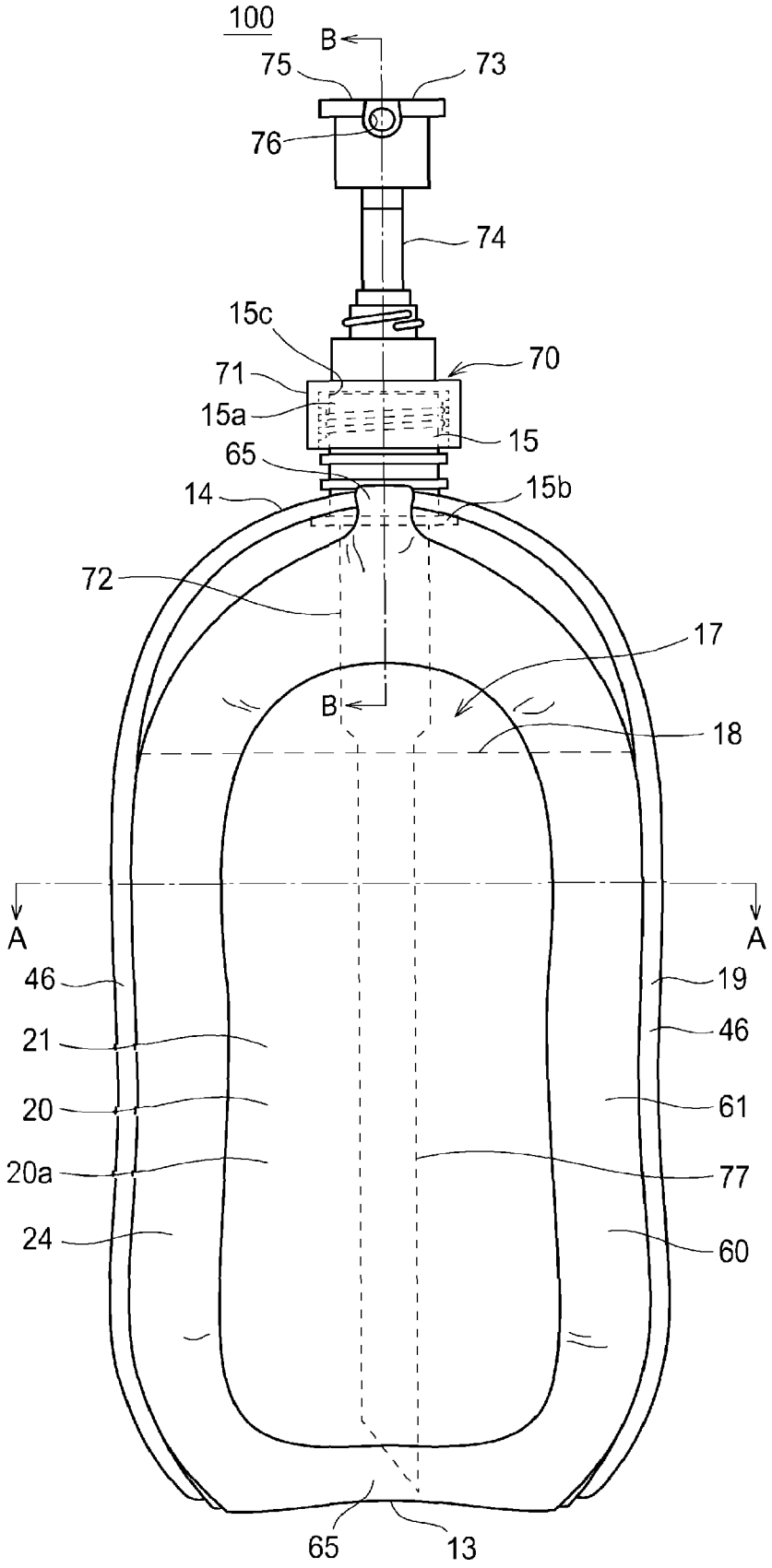
FIG. 2 is a front view illustrating a state where the filler is enclosed in the sheet member container according to the first exemplary embodiment.

In this exemplary embodiment, the positional relationship (up-down relationship or the like) of each constituent component of the sheet member container 100 is described in terms of a positional relationship in a state where the sheet member container 100 is caused to stand independently as illustrated in FIG. 1 and FIG. 2, unless otherwise specified. However, the positional relationship in this description does not necessarily match the positional relationship at the time of using or manufacturing the sheet member container 100.

Furthermore, in connection with the positional relationship of each constituent component of the sheet member container 100, the positional relationship illustrated in each of the drawings may be described.

A front surface side (side of the viewer of a paper surface in FIG. 2) of the sheet member container 100 is referred to as a forward direction; a back surface side (side away from the viewer of the paper surface in FIG. 2) of the sheet member container 100 is referred to as a rearward direction; the left side (left side in FIG. 2) as viewed from the front surface of the sheet member container 100 is referred to as a leftward direction; and the right side (right side in FIG. 2) as viewed from the front surface of the sheet member container 100 is referred to as a rightward direction. Furthermore, the left-right direction of the sheet member container 100 may be referred to as a widthwise direction.

In the present invention, types of contents 18 are not specifically limited. The contents 18 include, for example, shampoo, conditioner, body soap, detergent, bleach, softener, beverage, and food, and include engine oil, chemical agent, and the like.

In addition, the contents 18 may be a liquid (including a form of paste), or may be a solid (for example, in a form of particle (including a form of grain) or in a form of powder).

In the case of this exemplary embodiment, the contents 18 are, for example, a liquid.

In a case where the contents 18 are a liquid, a viscosity of the contents 18 at, for example, 30° C. preferably falls in a range of equal to or more than 1 mPa·s and equal to or less than 120000 mPa·s (measured by a B-type viscometer; for example, measured using viscometer TV-10 or viscometer TVB-10 made by Toki Sangyo Co., LTD. or the like), and more preferably falls in a range of equal to or more than 1 mPa·s and equal to or less than 60000 mPa·s.

In the case of this exemplary embodiment, the container main body 20 is formed into a bag shape including a body portion 11, the top gusset portion 14 arranged on an upper side of the body portion 11, and the bottom gusset portion 13 arranged on a lower side of the body portion 11. However, the present invention is not limited to this example, and the container main body 20 does not have to include the top gusset portion 14, or does not have to include the bottom gusset portion 13.

The container main body 20 surrounds the containing portion 17 (surrounds an inner bag 40 in the case of this exemplary embodiment). The container main body 20 constitutes a shell of the sheet member container 100. Below, the body portion 11, the top gusset portion 14 and the bottom gusset portion 13 of the container main body 20 may be referred to as the body portion 11, the top gusset portion 14 and the bottom gusset portion 13 of the sheet member container 100.

The shape of the front surface of the body portion 11 is not specifically limited. However, in the case of this exemplary embodiment, as illustrated, for example, in FIG. 2, the shape is a vertically long shape having a substantially constant width size, and an upper edge of the body portion 11 is formed into an upward protruding arc shape.

Figure 5:
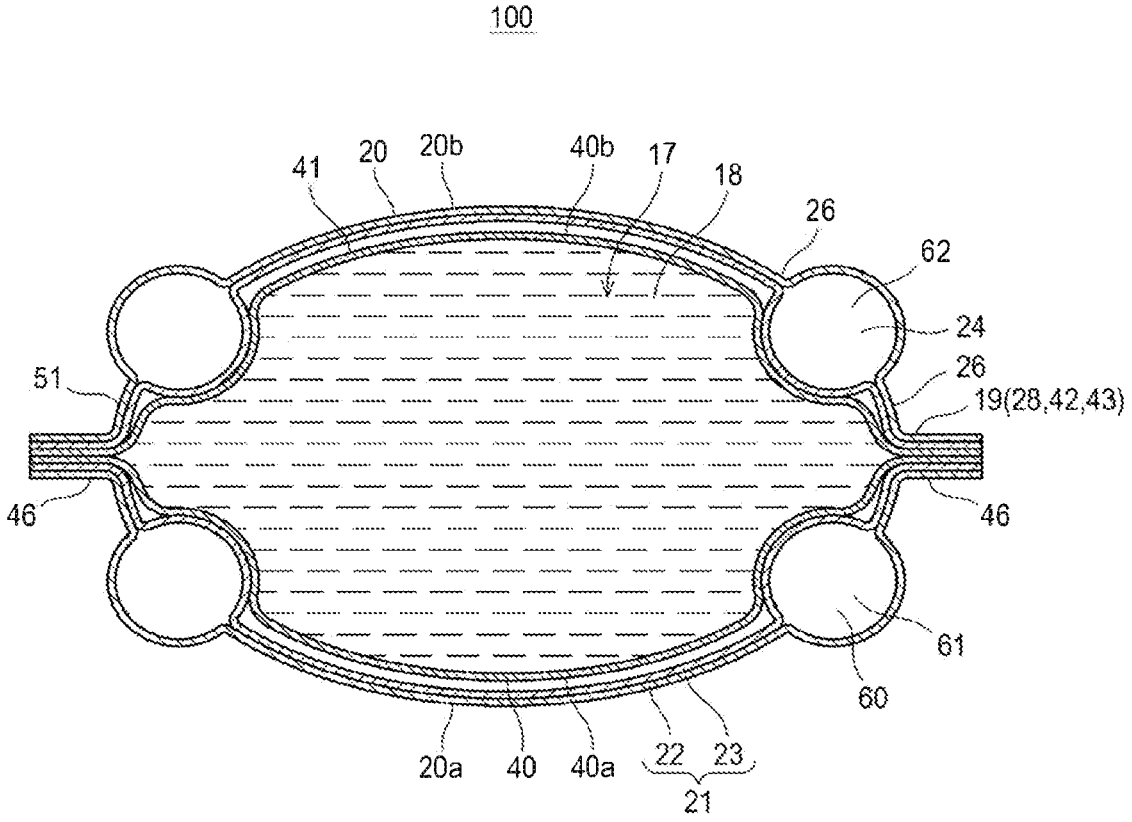
FIG. 5 is a cross-sectional view taken along the A-A line in FIG. 2.

As illustrated in FIG. 5, the body portion 11 includes the first main surface portion 20*a* (front panel) and a second main surface portion 20*b* (rear panel), which are opposed to each other with the containing portion 17 being arranged therebetween. The first main surface portion 20*a* is located at a front surface side, and the second main surface portion 20*b* is located at a back surface side (also see FIG. 1 to FIG. 3).

The first main surface portion 20*a* is formed, for example, in left-right symmetry, and the second main surface portion 20*b* is also formed, for example, in left-right symmetry. Also, the first main surface portion 20*a* and the second main surface portion 20*b* are formed, for example, in forward-rearward symmetry excluding the interfacial connecting portion 65 of the filling portion 60 that will be described later.

The first main surface portion 20*a* convexly bulges forward, and the second main surface portion 20*b* convexly bulges rearward.

The container main body 20 is formed by folding the main-body forming sheet member 21 (see FIG. 8 and FIG. 9) and attaching peripheral edge portions of the main-body forming sheet member 21 to each other (attaching the portions to each other via the inner-bag forming sheet member 41 that constitutes the inner bag 40 in the case of this exemplary embodiment).

Figure 3:
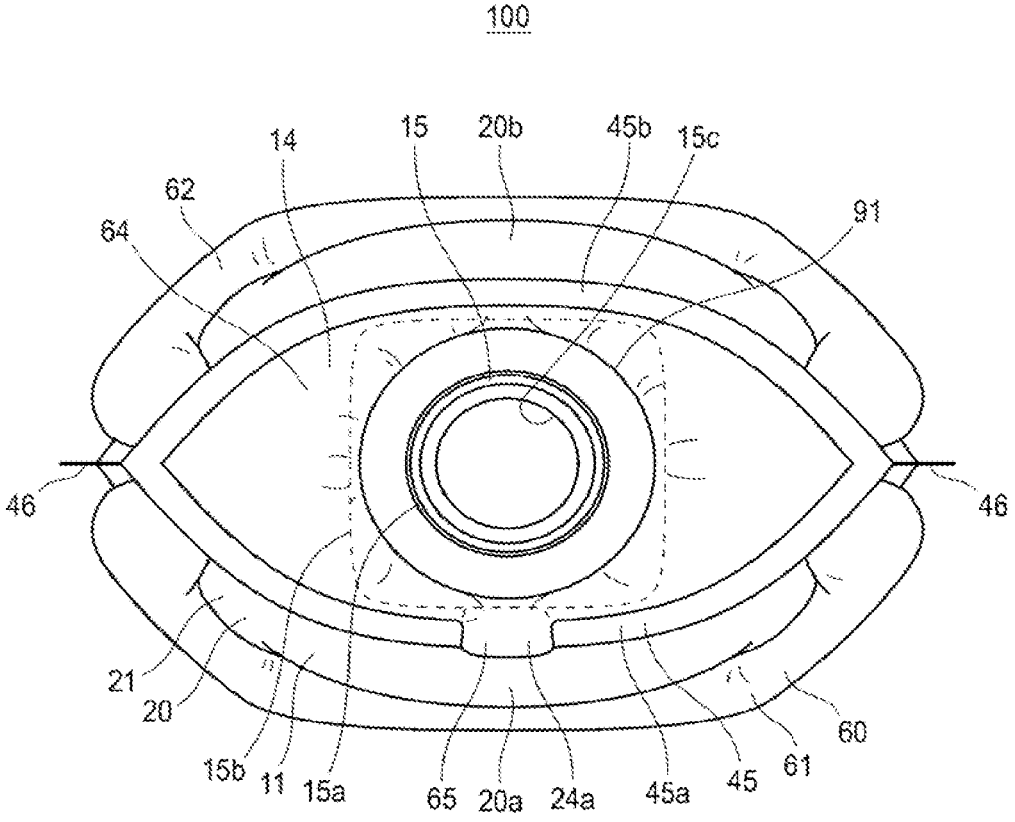
FIG. 3 is a plane view illustrating a state where the filler is enclosed in the sheet member container according to the first exemplary embodiment, and a cap portion is removed.
Figure 4:
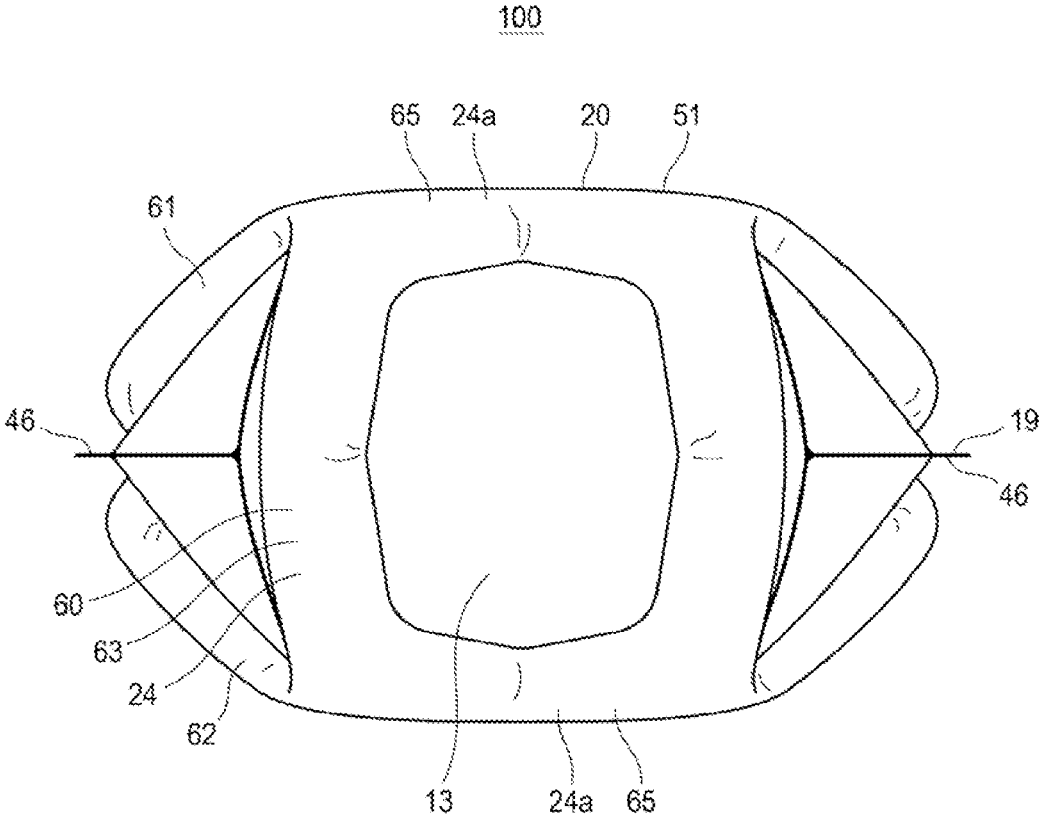
FIG. 4 is a bottom view of the sheet member container according to the first exemplary embodiment.

The planar shape of the top gusset portion 14 is not specifically limited, but in the case of this exemplary embodiment, as illustrated in FIG. 3, the top gusset portion 14 is formed into a shape having a front-back width reduced as being from a central portion toward the left in the widthwise direction, and reduced as being from the central portion toward the right in the widthwise direction. The top gusset portion 14 is formed into, for example, a horizontal tonsil shape.

The container main body 20 includes a gusset-portion peripheral edge sealing piece 45 arranged along a peripheral edge of the top gusset portion 14, and side portion sealing pieces 46 extending in an up-down direction along left and right edge portions of the body portion 11, respectively. The gusset-portion peripheral edge sealing piece 45 and the side portion sealing pieces 46, for example, stand outward from the container main body 20.

The gusset-portion peripheral edge sealing piece 45 surrounds the top gusset portion 14 in a circular shape, for example, excluding a portion where the interfacial connecting portion 65 described later exists.

The gusset-portion peripheral edge sealing piece 45 includes a first surface-portion-side sealing piece 45*a* arranged along a boundary between a gusset portion (top gusset portion 14) and the first main surface portion 20*a*, and a second surface-portion-side sealing piece 45*b* arranged along a boundary between the gusset portion and the second main surface portion 20*b*.

In the case of this exemplary embodiment, the inner bag 40 is formed (see FIG. 5) by attaching portions in the peripheral edge portion of the inner-bag forming sheet member 41 (see FIG. 9) to each other. That is, the inner bag 40 having a bag shape is formed by folding the inner-bag forming sheet member 41 and attaching the peripheral edge portions of the inner-bag forming sheet member 41 to each other. The inner bag 40 is covered with the container main body 20. The inner bag 40 includes the containing portion 17 within the inner bag 40.

Thus, the sheet member container 100 includes the inner bag 40 arranged in an inside of the container main body 20, and the inner bag 40 includes the inner-bag forming sheet member 41 that is an innermost layer sheet member of one or a plurality of sheet members that constitute the sheet member container 100.

However, in the present invention, in a case where an inner container defining the containing portion 17 is arranged in an disposed inside of the container main body 20, the inner container is not limited to the inner bag 40 including the sheet member, and may be formed, for example, through blow molding.

The shape of the inner bag 40 is not specifically limited. However, in the case of this exemplary embodiment, the inner bag 40 is formed into a shape similar to that of the container main body 20.

As illustrated in FIG. 5, the inner bag 40 includes a first main surface portion 40*a* located at the front surface side and a second main surface portion 40*b* located at the back surface side with the containing portion 17 being arranged therebetween.

The sheet member container 100 includes, for example, a spout member 15 arranged to penetrate through the top gusset portion 14, and a cap portion 70 mounted (for example, detachably mounted) to the spout member 15.

Figure 6:
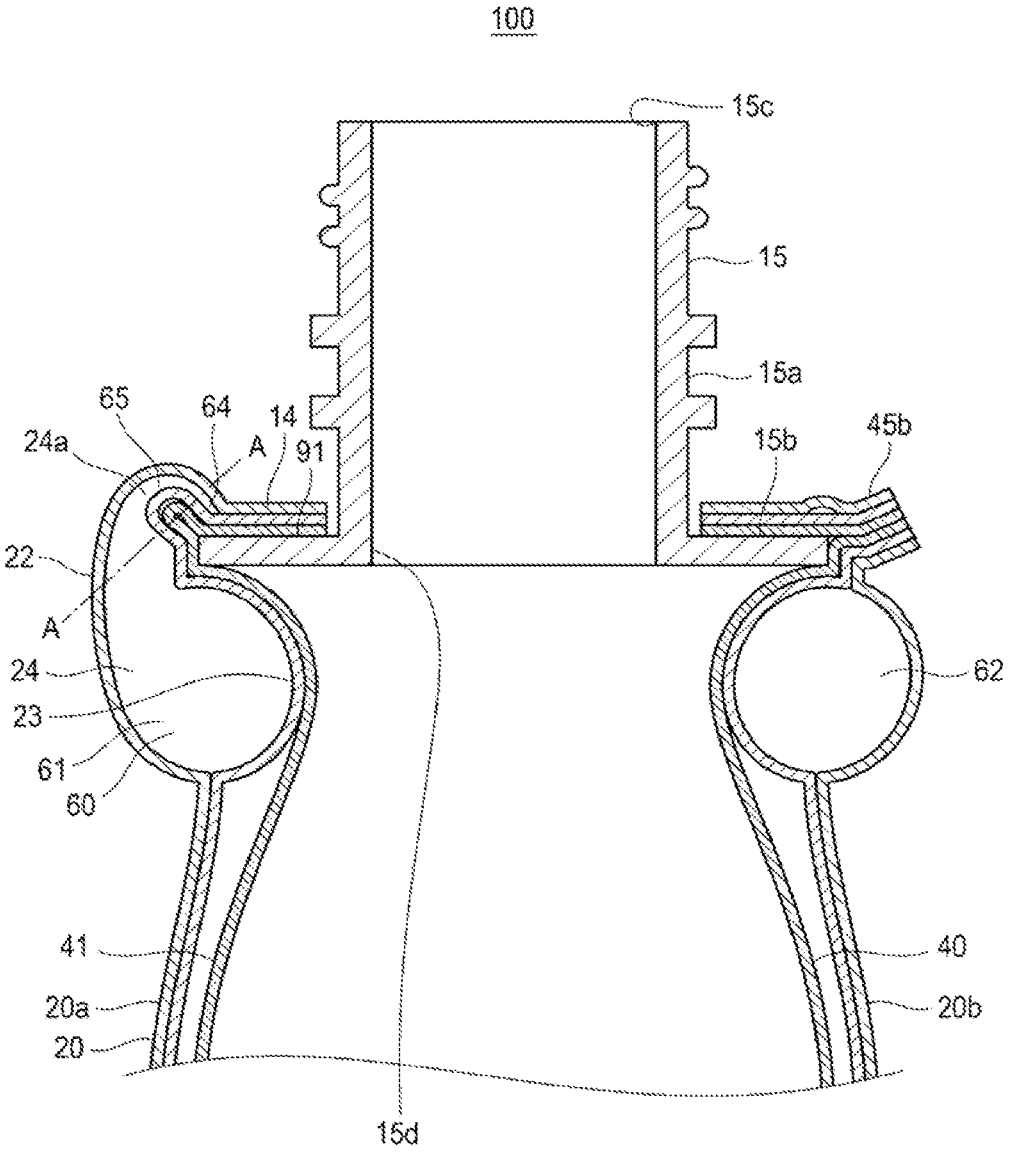
FIG. 6 is a cross-sectional view taken along the B-B line in FIG. 2.

More specifically, for example, as illustrated in FIG. 2, FIG. 3 and FIG. 6, the spout member 15 includes a cylindrical outlet cylinder portion 15*a* through which the contents 18 are caused to pass, and a plate shape portion 15*b* having a plate shape and arranged at one end (lower end) of the outlet cylinder portion 15*a* in an axial direction to be perpendicular to this axial direction, the portions being provided in an integral manner. The outlet cylinder portion 15*a* has an outer peripheral surface in which a thread is formed, and the outlet cylinder portion 15*a* has an external screw shape. The outlet cylinder portion 15*a* penetrates through the top gusset portion 14 in the up-down direction, and protrudes upward from the top gusset portion 14.

The plate shape portion 15*b* protrudes from the lower end of the outlet cylinder portion 15*a* toward a periphery thereof in a flange manner. The planar shape of the plate shape portion 15*b* is not specifically limited, and may be, for example, a substantially square shape (FIG. 3).

The plate shape portion 15*b* is arranged, for example, on an inner surface or an external surface of a portion arranged along the top gusset portion 14 of the body portion 11 in the inner-bag forming sheet member 41. As illustrated, for example, in FIG. 6, the plate shape portion 15*b* is attached to an inner surface (lower surface) of the inner-bag forming sheet member 41 in the top gusset portion 14, in an attached portion 91. Consequently, the plate shape portion 15*b* is attached to the main-body forming sheet member 21 via the inner-bag forming sheet member 41. However, the present invention is not limited to this example, and the plate shape portion 15*b* may be attached directly to the inner film layer 23 of the main-body forming sheet member 21. The attached portion 91 surrounds the periphery of the outlet cylinder portion 15*a* in a circular shape in plane view. The attached portion 91 is formed, for example, in the same region as in the annular main-body sealing portion 26 (see FIG. 10) located around an insert hole 21*a*.

An opening 15*c* in a tip end of the outlet cylinder portion 15*a* is a discharge port through which the contents 18 are discharged from the containing portion 17. In the plate shape portion 15*b*, an opening 15*d* is formed coaxially with an inner space of the outlet cylinder portion 15*a*. The contents 18 in the containing portion 17 are discharged outward through the opening 15*d* and the opening 15*c*.

Thus, the discharge port (opening 15*c*) through which the contents 18 are discharged from the containing portion 17 is arranged in the second surface portion (top gusset portion 14).

Further, in the second surface portion (top gusset portion 14), the plate shape portion 15*b* including the opening (opening 15*d*) that communicates to the discharge port (opening 15*c*) is arranged, and the above one or plurality of sheet members are attached to the plate shape portion 15*b*.

The cap portion 70 includes a mounting portion 71 that is a cylindrical portion with an internal screw shape removably screwed to the outlet cylinder portion 15*a*, a pump portion 72 fixed to the mounting portion 71, a dip tube 77 extending downward from the pump portion 72, and a head portion 73 held by the pump portion 72 to be raised and lowered to the pump portion 72.

The head portion 73 includes, for example, a support cylinder portion 74 protruding upward from the pump portion 72, and a nozzle portion 75 protruding horizontally from an upper end portion of the head portion 73, and a discharge port 76 through which the contents 18 are discharged is formed at a tip end of the nozzle portion 75.

A flow path (not shown in the drawings) of the contents 18 in the cap portion 70 is arranged to penetrate through the opening 15*d* and the opening 15*c* in the up-down direction.

When the head portion 73 is pushed into the pump portion 72 (pushed downward), the pump portion 72 operates to discharge the contents 18 through the discharge port 76.

In the case of this exemplary embodiment, as illustrated in FIG. 1 to FIG. 6, the filling portion 60 includes, for example, a first filling portion 61 formed into a circular shape along a peripheral edge portion of the first main surface portion 20*a*, a second filling portion 62 formed into a circular shape along a peripheral edge portion of the second main surface portion 20*b*, a third filling portion 63 (FIG. 4) formed into a circular shape along a peripheral edge portion of the bottom gusset portion 13, and a fourth filling portion 64 (FIG. 3) formed into a circular shape around the outlet cylinder portion 15*a* in the top gusset portion 14.

A lower edge of the first filling portion 61 is connected to a front edge of the third filling portion 63, a lower edge of the second filling portion 62 is connected to a rear edge of the third filling portion 63, and a central portion of an upper end portion of the first filling portion 61 in a widthwise direction is connected to a central portion of a front-end portion of the fourth filling portion 64 in the widthwise direction.

The sheet member container 100 includes the filling portion 60 with this structure, and accordingly structural strength is sufficiently acquired substantially over the whole container main body 20.

In the case of this exemplary embodiment, the whole filling portion 60 is formed in an integrated manner.

Alternatively, in the present invention, the sheet member container 100 may include a plurality of filling portions 60 that are independent of each other.

Here, each of a connecting portion between the first filling portion 61 and the fourth filling portion 64, a connecting portion between the first filling portion 61 and the third filling portion 63 and a connecting portion between the second filling portion 62 and the third filling portion 63 is the interfacial connecting portion 65.

Each interfacial connecting portion 65 is narrowed. That is, the filling portion 60 is narrowed in the interfacial connecting portion 65. Each of connecting portions 24*a* (FIG. 9 and FIG. 10) that are portions forming the interfacial connecting portions 65 in the non-attached region 24 is narrowed. Consequently, when the filler is enclosed, a speed of the filler that passes through the interfacial connecting portion 65 increases, and hence the filler can easily flow between the filling portion 60 of the first surface portion and the filling portion 60 of the second surface portion. All regions of the filling portion 60 in the sheet member container 100 can be easily filled with a predetermined amount of filler.

In the case of this exemplary embodiment, the container main body 20 includes the body portion 11 and the top portion (top gusset portion 14). One main surface portion (the first main surface portion 20*a*) of the body portion 11 is the first surface portion, and the top portion is the second surface portion.

Then, the filling portion 60 includes the first filling portion 61 formed along the peripheral edge portion of the main surface portion (first main surface portion 20*a*), and the fourth filling portion 64 formed around the discharge port in the top portion (top gusset portion 14), and the first filling portion 61 is connected to the fourth filling portion 64 via the interfacial connecting portion 65.

Additionally, in the case of this exemplary embodiment, the container main body 20 includes the body portion 11 and the bottom portion (bottom gusset portion 13). One main surface portion (the first main surface portion 20*a*) of the body portion 11 is the first surface portion, and the bottom portion (bottom gusset portion 13) is the second surface portion.

Then, the filling portion 60 includes the first filling portion 61 formed along the peripheral edge portion of the main surface portion (first main surface portion 20*a*), and the third filling portion 63 formed along the peripheral edge portion of the bottom portion (bottom gusset portion 13), and the first filling portion 61 is connected to the third filling portion 63 via the interfacial connecting portion 65.

Further, in the case of this exemplary embodiment, the other main surface portion (second main surface portion 20*b*) of the body portion 11 and the bottom portion (bottom gusset portion 13) also have a relationship between the first surface portion and the second surface portion.

Each interfacial connecting portion 65 is arranged in a central portion of the sheet member container 100 in the widthwise direction. Consequently, when the filler is enclosed, the filler evenly flows through the filling portion 60, which improves fillability.

Figure 8:
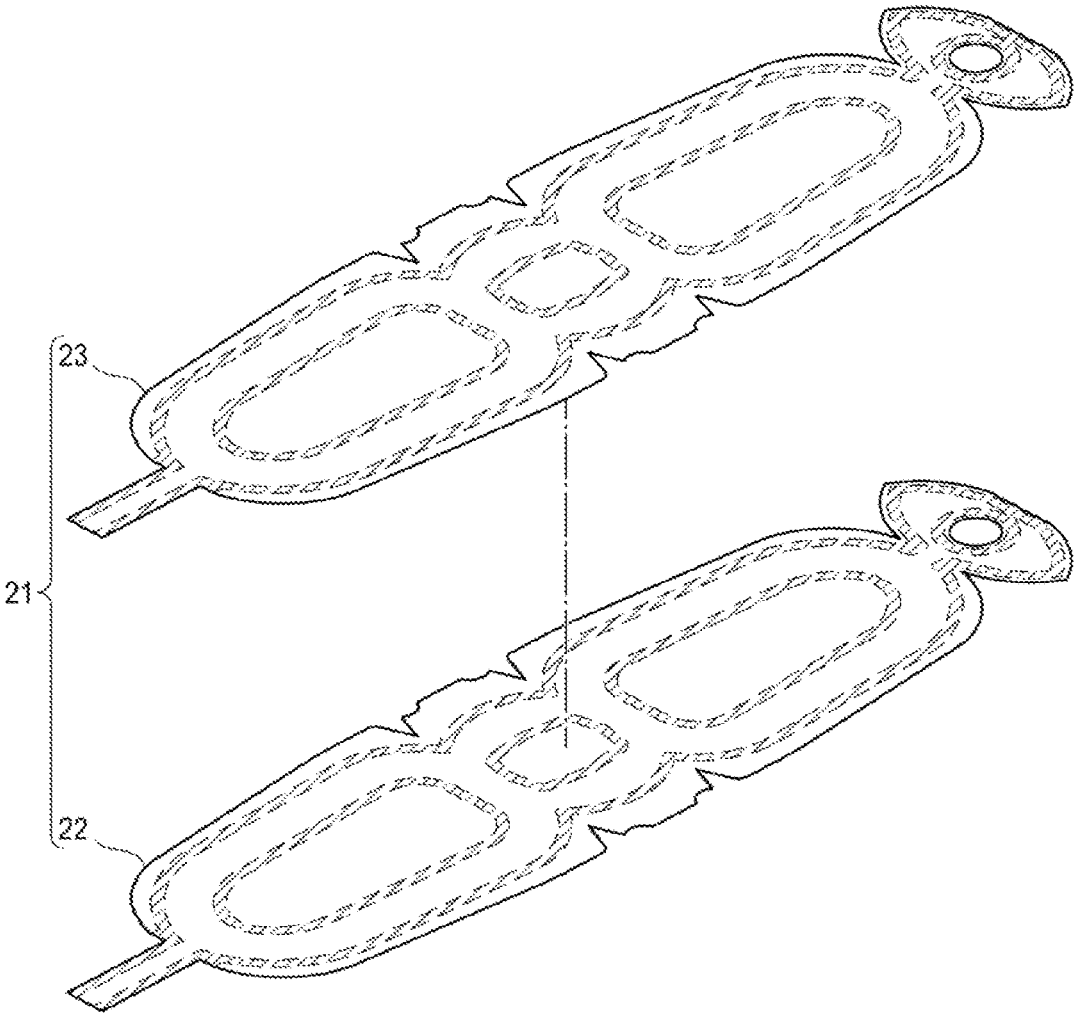
FIG. 8 is an exploded perspective view illustrating an outer film layer and an inner film layer of a main-body forming sheet member.
Figure 9:
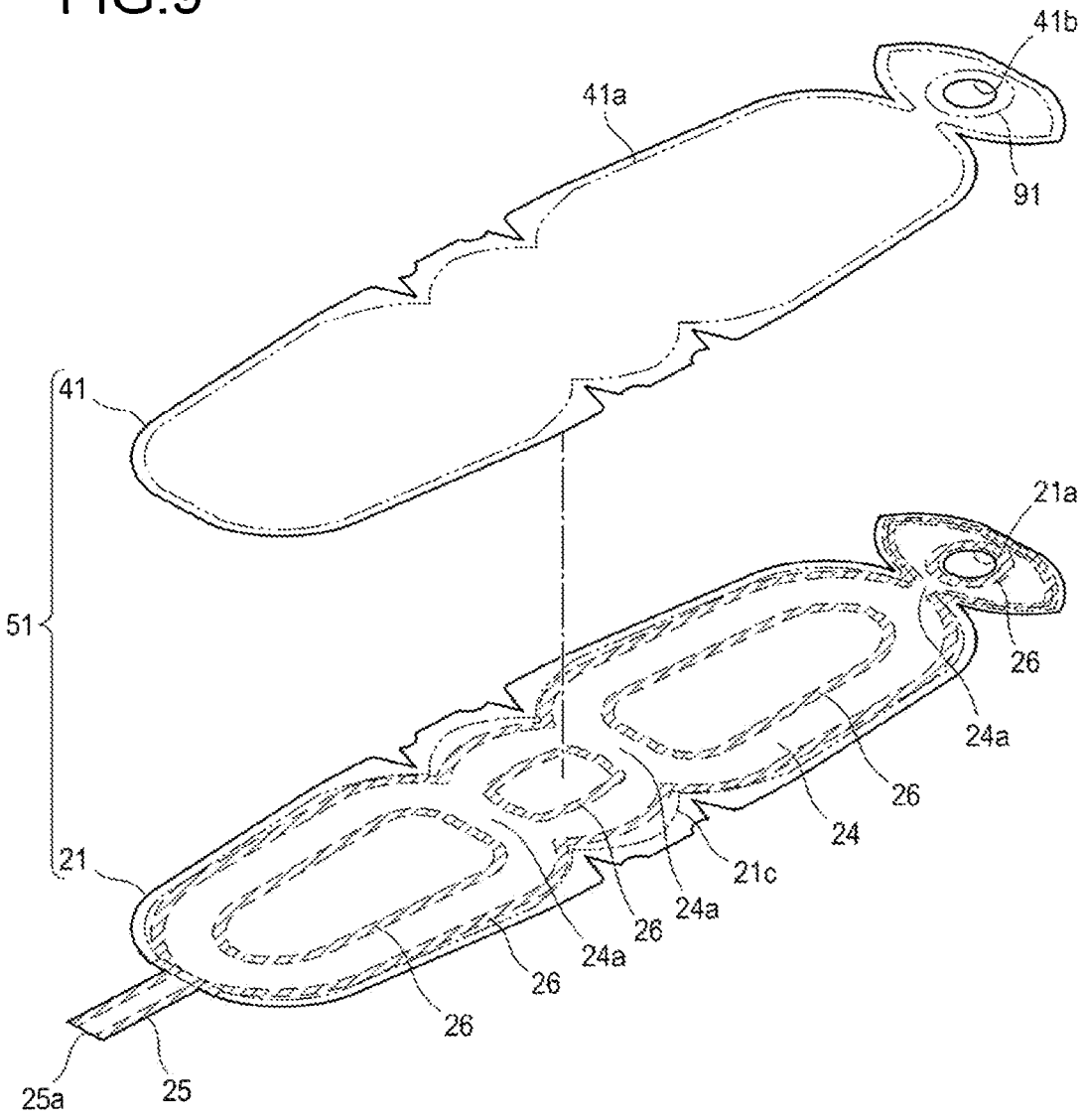
FIG. 9 is an exploded perspective view illustrating an inner-bag forming sheet member and the main-body forming sheet member.

As illustrated in FIG. 8 and FIG. 9, the main-body forming sheet member 21 is formed by laminating and attaching the outer film layer 22 that constitutes an external surface side of the container main body 20 and the inner film layer 23 that constitutes an inner surface side of the container main body 20 onto each other. That is, as an example, in the case of this exemplary embodiment, the main-body forming sheet member 21 includes two film layers of the outer film layer 22 and the inner film layer 23. However, the present invention is not limited to this example, and the main-body forming sheet member 21 may include a film layer other than the outer film layer 22 or the inner film layer 23.

In the case of this exemplary embodiment, the outer film layer 22 and the inner film layer 23 are formed into the same shape. However, the present invention is not limited to this example. The outer film layer 22 and the inner film layer 23 may have shapes different from each other. In a case where the shapes are different, it is preferable that the shape of the outer film layer 22 is larger than that of the inner film layer 23.

In the outer film layer 22 and the inner film layer 23, insert holes are formed into which the outlet cylinder portion 15*a* of the spout member 15 is inserted.

In the main-body forming sheet member 21, the non-attached region 24 (FIG. 9) in which the outer film layer 22 and the inner film layer 23 are partially not attached is formed. For example, a non-attaching treatment is partially applied to a surface of one or both of the outer film layer 22 and the inner film layer 23, this surface facing a surface of the other layer. The non-attaching treatment can be easily performed by applying a non-attaching agent (so-called adhesion inhibiting agent) to bring an adhesion inhibiting state. For the adhesion inhibiting agent, any agent can be used, provided that it can inhibit the outer film layer 22 and the inner film layer 23 from being attached together. For the adhesion inhibiting agent, it is possible to preferably use, for example, printing ink, medium ink, ink dedicated to adhesion inhibition, or the like for use in offset printing, flexography, and letterpress printing (relief printing). In addition, it is also possible to preferably use thermosetting ink or UV curable ink. The range to which the non-attaching treatment is applied is to be the non-attached region 24. When the filler is enclosed in the non-attached region 24, the filling portion 60 is formed.

The filling portion 60 is not necessarily limited to a filling portion formed in the whole non-attached region 24, and may be formed in some of a plurality of non-attached regions 24.

FIG. 8 illustrates, with hatching that rises to the right for convenience, a region in which the outer film layer 22 and the inner film layer 23 are attached to each other to form the main-body sealing portion 26.

Figure 10:
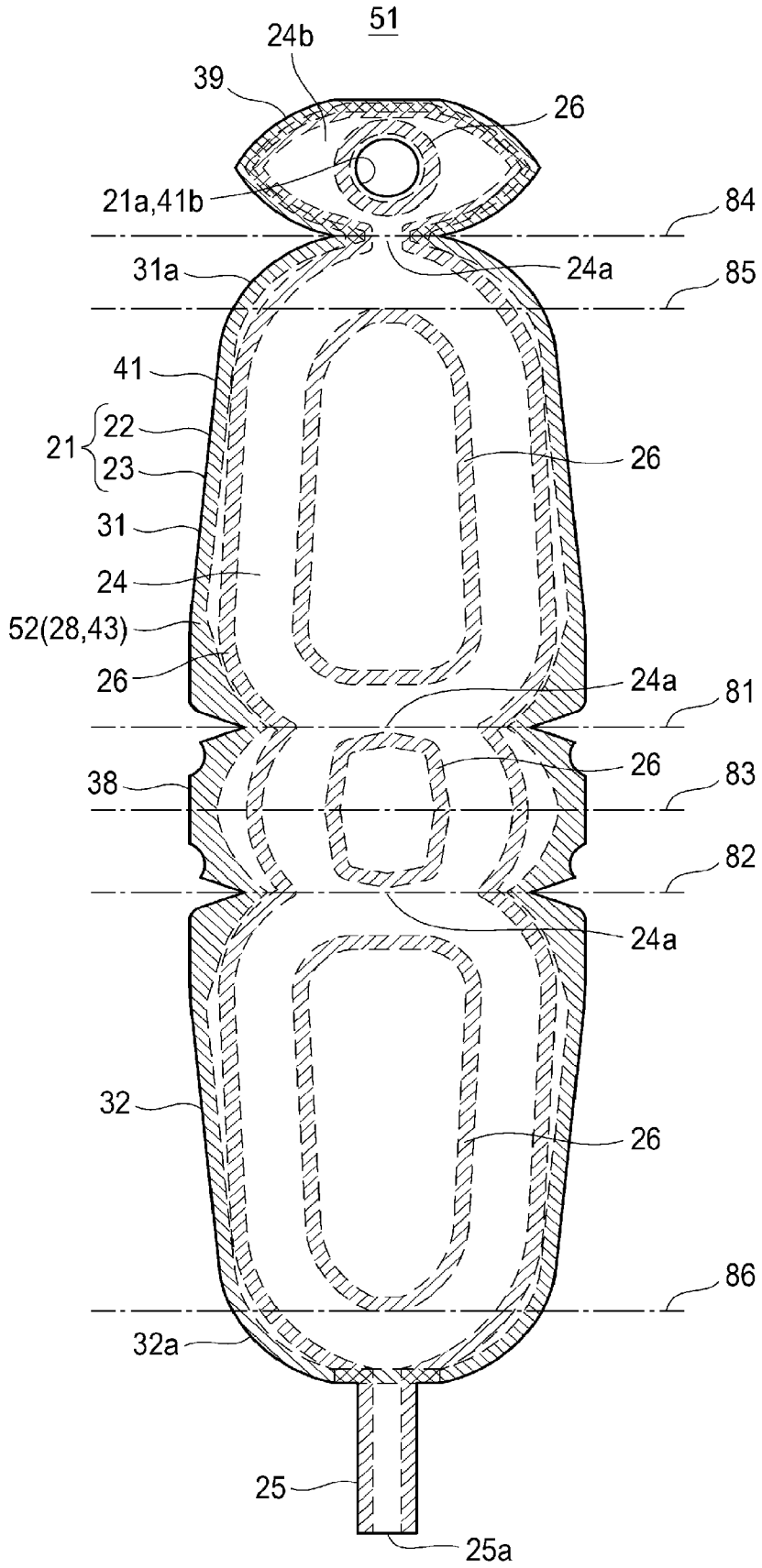
FIG. 10 is a plane view illustrating a container forming sheet member including the inner-bag forming sheet member and the main-body forming sheet member that are laminated on each other.

FIG. 9 and FIG. 10 illustrate, with hatching that rises to the right for convenience, a region in which the outer film layer 22 and the inner film layer 23 are attached to each other to define the non-attached region 24 in the main-body forming sheet member 21, that is, a region in which the main-body sealing portion 26 is formed.

Further, FIG. 9 illustrates, with a dashed line, a seal boundary line 21*c* that is a boundary line between the seal region of the peripheral edge portion of the main-body forming sheet member 21 and another region. In the case of this exemplary embodiment, the outer film layer 22 and the inner film layer 23 are attached to each other and the inner film layer 23 and the inner-bag forming sheet member 41 are attached to each other, in a region on an outer side of the seal boundary line 21*c* of the main-body forming sheet member 21 when a bag is formed.

As for a method of attaching the outer film layer 22 and the inner film layer 23 together, heat sealing, ultrasonic sealing, attaching with adhesive or the like may be used as an example.

In the case of this exemplary embodiment, each of the outer film layer 22 and the inner film layer 23 has a layer structure including a plurality of resin layers. Also, the inner-bag forming sheet member 41 has a layer structure including a plurality of resin layers.

The main-body forming sheet member 21 preferably includes the resin layer of at least one type of polyethylene, polypropylene, polyester, and polyamide.

A material of the resin layer that constitutes the outer film layer 22 and the inner film layer 23 of the main-body forming sheet member 21 is not specifically limited. For example, the material is more preferably one of a polyethylene material such as high density polyethylene (HDPE), medium density polyethylene (MDPE), low density polyethylene (LDPE), linear low-density polyethylene (LLDPE), ultralow density polyethylene (ULDPE) or ethylene-vinyl alcohol copolymer (EVOH); a polypropylene material such as oriented polypropylene (OPP), cast polypropylene (CPP), isotactic PP, syndiotactic PP, atactic PP, random PP or block PP; a polyester material such as polyethylene terephthalate (PET), amorphous polyethylene terephthalate (amorphous PET), polybutylene terephthalate (PBT), polyethylene naphthalate (PEN) or polybutylene naphthalate (PBN); or a polyamide material such as oriented nylon (ONy), cast nylon (CNy), nylon 6, nylon 66, nylon 11, nylon 12 or MXD6. Of these materials, the above polyethylene material is especially preferable.

As one example, the outer film layer 22 has a four-layer structure formed by laminating four resin layers of a first layer, a second layer, a third layer, and a fourth layer in this order.

Of these layers, the first layer constitutes an external surface of the container main body 20. The first layer includes, for example, polyethylene terephthalate (PET) or oriented nylon (ONy). The main function of the first layer is to provide the container main body 20 with a feeling of gloss and printability, and to provide the container main body 20 with rigidity.

The second layer is, for example, a layer of transparent deposition PET including polyethylene terephthalate obtained through vapor deposition of silica and/or alumina on a surface of this second layer on the first layer side. The main function of the second layer is to provide the container main body 20 with a gas barrier property.

The third layer includes, for example, oriented nylon. The main function of the third layer is to provide the container main body 20 with a pinhole resistance.

The fourth layer includes, for example, linear low-density polyethylene (LLDPE). The main function of the fourth layer is to achieve a heat seal property with the inner film layer 23.

An example of the layer structure of the inner film layer 23 is a structure including a fifth layer including, for example, linear low-density polyethylene (LLDPE) in addition to a layer structure similar to the outer film layer 22 including the first layer to the fourth layer. The fifth layer is adjacent to the first layer, and constitutes a surface opposite to the fourth layer in the inner film layer 23. The main function of the fifth layer is to achieve a heat seal property with the outer film layer 22.

The main function of the fourth layer of the inner film layer 23 is to achieve a heat seal property with the inner-bag forming sheet member 41.

However, the layer structure of the outer film layer 22 and the inner film layer 23 is not limited to the above example, and the material of each of the layers that constitute the outer film layer 22 and the inner film layer 23 is not limited to the examples described above.

As one example, the inner-bag forming sheet member 41 that constitutes the inner bag 40 has a three-layer structure formed by laminating a first layer, a second layer and a third layer in this order.

Of these layers, the first layer includes, for example, linear low-density polyethylene. The main function of the first layer is to achieve a heat seal property (heat seal property with the inner film layer 23) with the main-body forming sheet member 21.

The second layer is, for example, a layer of transparent deposition oriented nylon including oriented nylon obtained through vapor deposition of silica and/or alumina on a surface of this second layer on the first layer side. The main function of the second layer is to achieve a gas barrier property and a pinhole resistance.

The third layer includes, for example, linear low-density polyethylene. The main function of the third layer is to achieve a heat seal property between portions of the inner-bag forming sheet member 41.

In addition, the layer structure of the inner-bag forming sheet member 41 is not limited to the structure described here.

As illustrated in FIG. 9 and FIG. 10, the inner-bag forming sheet member 41 is laminated on the main-body forming sheet member 21, and as illustrated in FIG. 10, a peripheral edge portion of the inner film layer 23 and the peripheral edge portion of the inner-bag forming sheet member 41 are attached to each other, and a peripheral edge portion of the outer film layer 22 and the peripheral edge portion of the inner film layer 23 are attached to each other. Consequently, the main-body forming sheet member 21 and the inner-bag forming sheet member 41 constitute a container forming sheet member 51.

Here, a sealing portion of a peripheral edge portion of the container forming sheet member 51 is referred to as a peripheral edge sealing portion 52. The peripheral edge sealing portion 52 includes a sealing portion (below, an inner-outer sealing portion 43) between the peripheral edge portion of the inner film layer 23 and the peripheral edge portion of the inner-bag forming sheet member 41, and a sealing portion (below, a main-body peripheral edge sealing portion 28) between the peripheral edge portion of the outer film layer 22 and the peripheral edge portion of the inner film layer 23.

FIG. 10 illustrates a region in which the peripheral edge sealing portion 52 is formed, with hatching that rises to the left. Also, in FIG. 10, hatching that rises to the left and hatching that rises to the right are overlapped in a region where the region in which the peripheral edge sealing portion 52 is formed overlaps with a region in which the main-body sealing portion 26 is formed.

As for a method of forming the peripheral edge sealing portion 52, heat sealing, ultrasonic sealing, attaching with adhesive or the like may be used as an example.

As illustrated in FIG. 10, the main-body forming sheet member 21 includes, for example: a first sheet portion 31 that is a portion constituting the first main surface portion 20*a*; a second sheet portion 32 that is a portion constituting the second main surface portion 20*b*; a bottom-gusset forming sheet portion 38 that is a portion constituting the bottom gusset portion 13; a top-gusset forming sheet portion 39 that is a portion constituting the top gusset portion 14; and a tube-shaped extending portion 25. For example, the extending portion 25 extends outward from the second sheet portion 32.

The insert hole 21*a* into which the outlet cylinder portion 15*a* of the spout member 15 is inserted is formed in the top-gusset forming sheet portion 39.

In the case of this exemplary embodiment, the non-attached region 24 is formed into a shape corresponding to a shape of the filling portion 60 of the sheet member container 100.

In the non-attached region 24, a portion 24*b* that forms the fourth filling portion 64 is formed into a circular shape that surrounds the insert hole 21*a* as illustrated, for example, in FIG. 10. More specifically, for example, an outer edge (external line) of the portion 24*b* has a shape slightly smaller than an external line of the top-gusset forming sheet portion 39, and an inner edge of the portion 24*b* has a circular shape slightly larger than that of the insert hole 21*a*.

In the case of this exemplary embodiment, the inner-bag forming sheet member 41 is formed into the same shape as in a portion of the main-body forming sheet member 21 excluding the extending portion 25.

In addition, FIG. 9 illustrates a seal boundary line 41*a* of the inner-bag forming sheet member 41, with a dashed line for convenience. The seal boundary line 41*a* is a boundary line between a region in which the inner-bag forming sheet member 41 is attached (sealed) to the main-body forming sheet member 21 and another region in the inner-bag forming sheet member 41, and is also a boundary line between a region in which portions of the inner-bag forming sheet member 41 are attached to each other and the other region in the inner-bag forming sheet member 41 when the sheet member container 100 is formed by using the container forming sheet member 51.

In the case of this exemplary embodiment, a position of the seal boundary line 41*a* and a position of the seal boundary line 21*c* correspond to each other (overlap with each other).

An insert hole 41*b* into which the outlet cylinder portion 15*a* of the spout member 15 is inserted is formed in a portion of the inner-bag forming sheet member 41 that overlaps with the top-gusset forming sheet portion 39.

The plate shape portion 15*b* of the spout member 15 is attached to, for example, an inner surface of the portion of the inner-bag forming sheet member 41 that overlaps with the top-gusset forming sheet portion 39. The outlet cylinder portion 15*a* is caused to pass through the insert hole 41*b* of the inner-bag forming sheet member 41 and the insert hole 21*a* of the top-gusset forming sheet portion 39, and protrudes toward the external surface side of these sheets.

Peripheral edge portions of the container forming sheet member 51 (the portions of the inner-bag forming sheet member 41) are attached to each other in a state where the container forming sheet member 51 is folded as valley fold along the folding line 81, the folding line 82, and the folding line 84 illustrated in FIG. 10, and is folded as mountain fold along the folding line 83 and the folding line 85. With this operation, the container forming sheet member 51 is formed into a bag shape with a double structure. Here, the valley fold means a way of folding in which it protrudes toward the side going away from the viewer of FIG. 10, and the mountain fold means a way of folding in which it protrudes toward the viewer of FIG. 10.

That is, edge portions of the inner-bag forming sheet member 41 are attached to each other to form an inner-bag sealing portion 42 (see FIG. 1). Thus, using the inner-bag forming sheet member 41, the inner bag 40 is formed. In addition, the bag-shaped container main body 20 that covers the inner bag 40 is formed.

As for a method of attaching the portions of the inner-bag forming sheet member 41 to each other, heat sealing, ultrasonic sealing, attaching with adhesive or the like may be used as an example.

In the case of this exemplary embodiment, the main-body peripheral edge sealing portion 28, the inner-bag sealing portion 42 and the inner-outer sealing portion 43 are arranged at positions that correspond to one another (positions that overlap with one another). The main-body peripheral edge sealing portion 28, the inner-bag sealing portion 42 and the inner-outer sealing portion 43 are generically referred to as the peripheral edge sealing portion 19 (the peripheral edge sealing portion 19 includes the main-body peripheral edge sealing portion 28, the inner-bag sealing portion 42 and the inner-outer sealing portion 43).

Consequently, in the case of this exemplary embodiment, each of the gusset-portion peripheral edge sealing piece 45 and the side portion sealing pieces 46 includes the main-body peripheral edge sealing portion 28, the inner-bag sealing portion 42 and the inner-outer sealing portion 43.

However, the present invention is not limited to this example, and the gusset-portion peripheral edge sealing piece 45 and the side portion sealing pieces 46 may only include the main-body peripheral edge sealing portion 28.

A portion of the first sheet portion 31 on a top-gusset forming sheet portion 39 side of the folding line 85 is a first overlapping portion 31*a*. The first overlapping portion 31*a* is arranged to overlap with one half portion in the top-gusset forming sheet portion 39 in a state before the non-attached region 24 is filled with the filler.

A portion of the second sheet portion 32 that is located away from the bottom-gusset forming sheet portion 38 via the folding line 86 is a second overlapping portion 32*a*. The second overlapping portion 32*a* is arranged to overlap with the other half portion in the top-gusset forming sheet portion 39 in the state before the non-attached region 24 is filled with the filler.

Thus, as illustrated in FIG. 12, the container forming sheet member 51 is formed into a double bag shape, to obtain the sheet member container 100. In the sheet member container 100, for example, the filler is inputted from an inlet port 25*a* (FIG. 10) formed in the extending portion 25 into the non-attached region 24. Afterward, the non-attached region 24 is sealed at a portion continuously connected to a base end side of the extending portion 25. This causes the filler to be enclosed in the non-attached region 24 (the filling portion 60).

In addition, a pressure within the filling portion 60 is not specifically limited. However, it is preferable that this pressure is higher than atmospheric pressure, and for example, can be set to be equal to or more than 10 kPa and equal to or less than 500 kPa (gauge pressure).

That is, the filling portion capable of containing the filler is a space located between layers of the outer film layer 22 and the inner film layer 23, and capable of keeping sealability when the filler is enclosed substantially at a pressure in a range of equal to or more than 10 kPa and equal to or less than 500 kPa.

After formation of the filling portion 60 in which the filler is enclosed, the extending portion 25 is cut off, for example.

In this manner, the sheet member container 100 in which the filler is enclosed in the filling portion 60 is obtained (see FIG. 1 to FIG. 7). Alternatively, the extending portion 25 may remain even in a state of the sheet member container 100 in which the filler is enclosed.

After the sheet member container 100 is manufactured, the containing portion 17 is filled with the contents 18 through the outlet cylinder portion 15*a* of the spout member 15. Afterward, the cap portion 70 is mounted to the spout member 15. This makes it possible to obtain the sheet member container 100 in which the contents 18 are enclosed in the containing portion 17.

FIG. 11 is a partially enlarged view of FIG. 10, and illustrates a boundary between the first sheet portion 31 that forms the first main surface portion 20*a* and the top-gusset forming sheet portion 39 that forms the top gusset portion 14, and a portion in the vicinity of the boundary.

In the case of this exemplary embodiment, the outer film layer 22, the inner film layer 23 and the inner-bag forming sheet member 41 have the same shape, and are laminated in a manner such that external lines match with one another.

Consequently, as illustrated in FIG. 11, in the boundary between the first sheet portion 31 that forms the first main surface portion 20*a* and the top-gusset forming sheet portion 39 that forms the top gusset portion 14, an outer edge 22*a* of the outer film layer 22, an outer edge 23*a* of the inner film layer 23 and an outer edge 41*c* of the inner-bag forming sheet member 41 align with one another. Also, in a boundary between the first sheet portion 31 and the bottom-gusset forming sheet portion 38 that forms the bottom gusset portion 13, the outer edge 22*a* of the outer film layer 22, the outer edge 23*a* of the inner film layer 23 and the outer edge 41*c* of the inner-bag forming sheet member 41 align with one another. Similarly, in a boundary between the second sheet portion 32 that forms the second main surface portion 20*b* and the bottom-gusset forming sheet portion 38, the outer edge 22*a* of the outer film layer 22, the outer edge 23*a* of the inner film layer 23 and the outer edge 41*c* of the inner-bag forming sheet member 41 also align with one another.

Then, also in a state after the container forming sheet member 51 forms the sheet member container 100, the outer edge 22*a* of the outer film layer 22, the outer edge 23*a* of the inner film layer 23 and the outer edge 41*c* of the inner-bag forming sheet member 41 align with one another in a boundary between the first main surface portion 20*a* and the top gusset portion 14, a boundary between the first main surface portion 20*a* and the bottom gusset portion 13, and a boundary between the second main surface portion 20*b* and the bottom gusset portion 13.

In FIG. 11, a region that forms the peripheral edge sealing portion 19 after the bag is manufactured is denoted with a reference numeral of the peripheral edge sealing portion 19.

As illustrated in FIG. 11, in the case of this exemplary embodiment, in the boundary between the first main surface portion 20*a* and the top gusset portion 14, the main-body forming sheet member 21 is folded along the folding line 84, and the peripheral edge portion of the first main surface portion 20*a* and a peripheral edge portion of the top gusset portion 14 are attached to each other by the peripheral edge sealing portion 19. In the peripheral edge sealing portion 19, all film layers that constitute the sheet member container 100 are attached. That is, in this exemplary embodiment, as illustrated in FIG. 7, six layers in total including the inner-bag forming sheet member 41, the inner film layer 23 and the outer film layer 22 in the first main surface portion 20*a*, and the inner-bag forming sheet member 41, the inner film layer 23 and the outer film layer 22 in the top gusset portion 14 are attached in the peripheral edge sealing portion 19.

As illustrated in FIG. 7 and FIG. 11, the end portion 19*a* of the peripheral edge sealing portion 19 along the folding line 84 is away from the boundary position 26*a* between the interfacial connecting portion 65 and the main-body sealing portion 26. Consequently, in the boundary between the first surface portion and the second surface portion, the region on the outer side of the interfacial connecting portion 65 (the region from the end portion 19*a* of the peripheral edge sealing portion 19 to the boundary position 26*a* between the interfacial connecting portion 65 and the main-body sealing portion 26) also has a structure where the film layers that constitute the sheet member container 100 (in this exemplary embodiment, the portions of the inner-bag forming sheet member 41, and the inner-bag forming sheet member 41 and the inner film layer 23) peel off each other. In this exemplary embodiment, the peripheral edge sealing portion 19 includes six layers of the sheet members attached as described above and therefore has high rigidity. On the other hand, in the boundary between the first surface portion and the second surface portion, the end portion 19*a* of the peripheral edge sealing portion 19 is away from the interfacial connecting portion 65, and hence the movement of the outer film layer 22 and the inner film layer 23 that constitute the interfacial connecting portion 65 (non-attached region 24) is hard to be regulated, and the space between the layers of the outer film layer 22 and the inner film layer 23 (the space in the non-attached region 24) is easily acquired. Consequently, when the filling portion is filled with the filler in the folded state along the folding line 84, the filler can easily flow between the filling portion 60 of the first surface portion and the filling portion 60 of the second surface portion. For example, the filling portion 60 of the first surface portion and the filling portion 60 of the second surface portion can be easily filled with the filler through the interfacial connecting portion 65.

Also, in the boundary between the first surface portion and the second surface portion, the main-body sealing portion 26 is adjacent to the peripheral edge sealing portion 19. That is, the non-attached region 24 does not exist between the peripheral edge sealing portion 19 and the main-body sealing portion 26. Consequently, in the state where the filler is enclosed in the filling portion 60, it is possible to suppress defects that stress is concentrated on the non-attached region 24 and that the sheet member tears.

Further, in the boundary between the first main surface portion 20*a* and the top gusset portion 14, a width size W1 of the peripheral edge sealing portion 19 along the folding line 84 is equal to or more than a width size W2 of the main-body sealing portion 26, and preferably, the width size W1 is larger than the width size W2. The width size W1 is a width of a region in which the first main surface portion 20*a* (the first surface portion) is connected to the top gusset portion 14 (the second surface portion) along the folding line 84 of the main-body forming sheet member 21 in the peripheral edge sealing portion 19.

The width size W1 is equal to or more than the width size W2, so that rigidity of a peripheral edge portion of the container main body 20 can be sufficiently acquired. Also, since the width size W1 is equal to or more than the width size W2, a contour of the boundary between the first main surface portion 20*a* and the top gusset portion 14 becomes clear. Therefore, a difference in appearance between the first main surface portion and the second main surface portion is hard to be made, and appearance of the sheet member container 100 can be favorably kept.

Also, in the boundary between the first main surface portion 20*a* and the top gusset portion 14, a total value of the width size W1 of the peripheral edge sealing portion 19 along the folding line 84 and the width size W2 of the main-body sealing portion 26 is larger than a half of a width size W3 of the interfacial connecting portion 65 (non-attached region 24). In other words, the width size W3 is smaller than twice the total value of the width size W1 and the width size W2. Consequently, the interfacial connecting portion 65 can be narrowed, and hence attractiveness of the boundary between the first main surface portion 20*a* and the top gusset portion 14 can be favorable. Here, the width size W3 of the interfacial connecting portion 65 is a size in a state where the filler is not enclosed.

Also, at a position where the interfacial connecting portion 65 exists as viewed in a thickness direction of the sheet member, none of the film layers that constitute the sheet member container 100 are attached to each other. That is, in the interfacial connecting portion 65, as illustrated in FIG. 7, a portion of the outer film layer 22, a portion of the inner film layer 23, a portion of the inner-bag forming sheet member 41, another portion of the inner film layer 23 and another portion of the outer film layer 22 are laminated in this order, but none of these portions are attached. Consequently, the respective film layers in the non-attached region 24 can relatively move freely to a certain degree, and hence the space between the layers of the outer film layer 22 and the inner film layer 23 (the space in the non-attached region 24) can be more reliably acquired in the boundary between the first surface portion and the second surface portion.

Next, modifications will be described with reference to FIG. 18 to FIG. 22.

Modification 1

In the above first exemplary embodiment, an example where the main-body sealing portion 26 is adjacent to the peripheral edge sealing portion 19 in the boundary between the first surface portion and the second surface portion has been described. On the other hand, in a case of Modification 1 illustrated in FIG. 18, a non-sealing portion 111 in which film layers are not attached to each other is interposed between a peripheral edge sealing portion 19 and a main-body sealing portion 26 in a boundary between a first surface portion and a second surface portion. In the non-sealing portion 111, an outer film layer 22 and an inner film layer 23 are not attached, and also the inner film layer 23 and an inner-bag forming sheet member 41 are not attached. That is, in the non-sealing portion 111, a portion of the outer film layer 22, a portion of the inner film layer 23, a portion of the inner-bag forming sheet member 41, another portion of the inner-bag forming sheet member 41, another portion of the inner film layer 23 and another portion of the outer film layer 22 are laminated in this order in a state of being not attached to each other.

Modification 2

In the above first exemplary embodiment and Modification 1, an example where the external lines of the outer film layer 22, the inner film layer 23 and the inner-bag forming sheet member 41 match one another, that is, an example where the outer edge 22*a* of the outer film layer 22, the outer edge 23*a* of the inner film layer 23 and the outer edge 41*c* of the inner-bag forming sheet member 41 align with one another in the boundary between the first surface portion and the second surface portion has been described. On the other hand, in a case of Modification 2 illustrated in FIG. 19, an external line of an inner film layer 23 is located on an inner side of an external line of an outer film layer 22. That is, in a boundary between a first surface portion and a second surface portion, an outer edge 23*a* of the inner film layer 23 is arranged on an inner side of an outer edge 22*a* of the outer film layer 22. In addition, the outer edge 22*a* of the outer film layer 22 and an outer edge 41*c* of an inner-bag forming sheet member 41 align with each other.

Then, in order from an outer edge of a sheet member container 100, a four-layer sealing portion 191, a six-layer sealing portion 192, the non-sealing portion 111 and a main-body sealing portion 26 are arranged in this order.

In the four-layer sealing portion 191, a portion of the outer film layer 22, a portion of the inner-bag forming sheet member 41, another portion of the inner-bag forming sheet member 41 and another portion of the outer film layer 22 are laminated in this order and attached to one another.

In the six-layer sealing portion 192, a portion of the outer film layer 22, a portion of the inner film layer 23, a portion of the inner-bag forming sheet member 41, another portion of the inner-bag forming sheet member 41, another portion of the inner film layer 23 and another portion of the outer film layer 22 are laminated in this order and attached to one another.

In the case of this modification, a peripheral edge sealing portion 19 includes the four-layer sealing portion 191 and the six-layer sealing portion 192.

Modification 3

Figure 19:
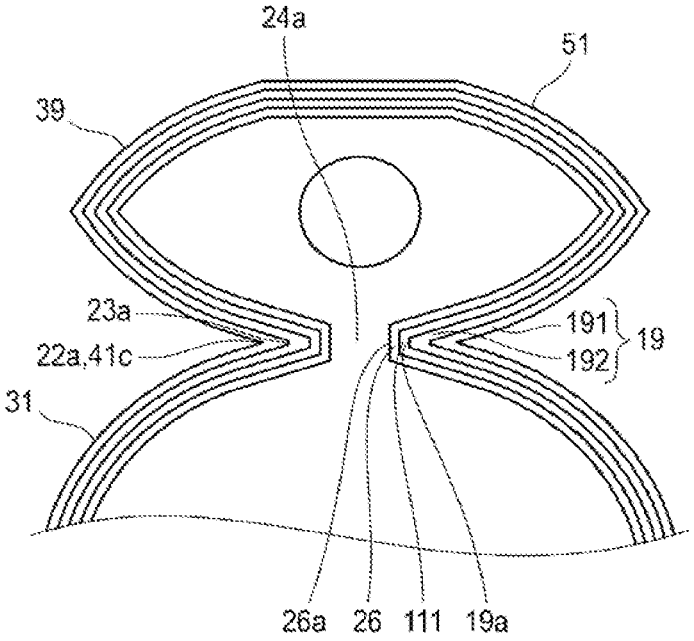
FIG. 19 is a partially enlarged view of a container forming sheet member for explaining a configuration of a sheet member container according to Modification 2.
Figure 20:
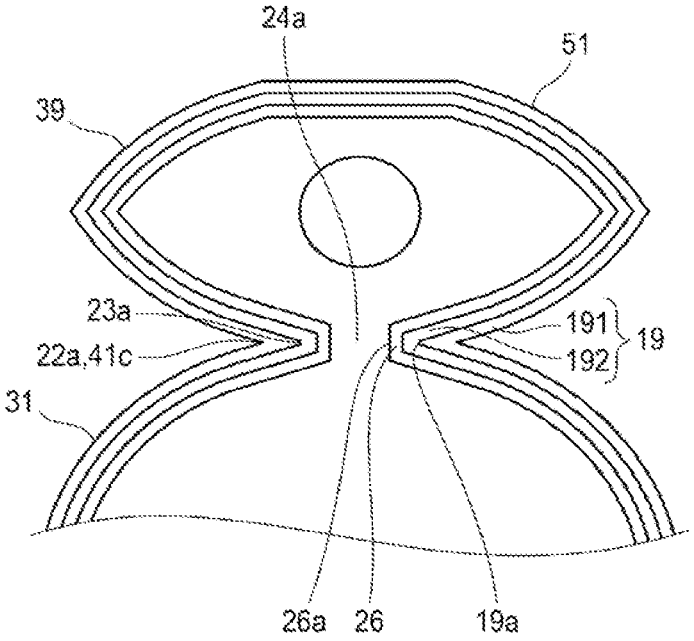
FIG. 20 is a partially enlarged view of a container forming sheet member for explaining a configuration of a sheet member container according to Modification 3.

Modification 3 illustrated in FIG. 20 is different from Modification 2 illustrated in FIG. 19 in that the sheet member container 100 does not include the non-sealing portion 111, and in other points, this modification is similar to Modification 2.

Modification 4

Figure 21:
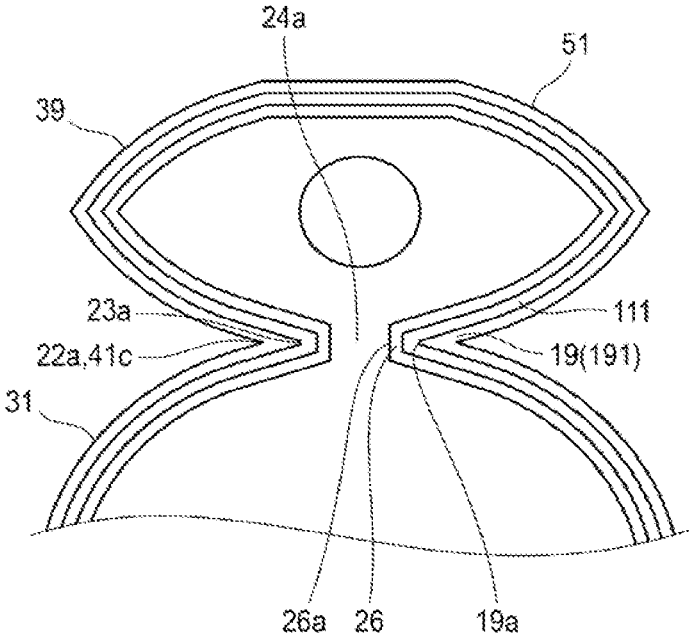
FIG. 21 is a partially enlarged view of a container forming sheet member for explaining a configuration of a sheet member container according to Modification 4.

Modification 4 illustrated in FIG. 21 is different from Modification 3 illustrated in FIG. 20 in that the non-sealing portion 111 is provided in place of the six-layer sealing portion 192, and in other points, this modification is similar to Modification 3. In a case of this modification, the peripheral edge sealing portion 19 only includes the four-layer sealing portion 191.

Modification 5

Figure 22:
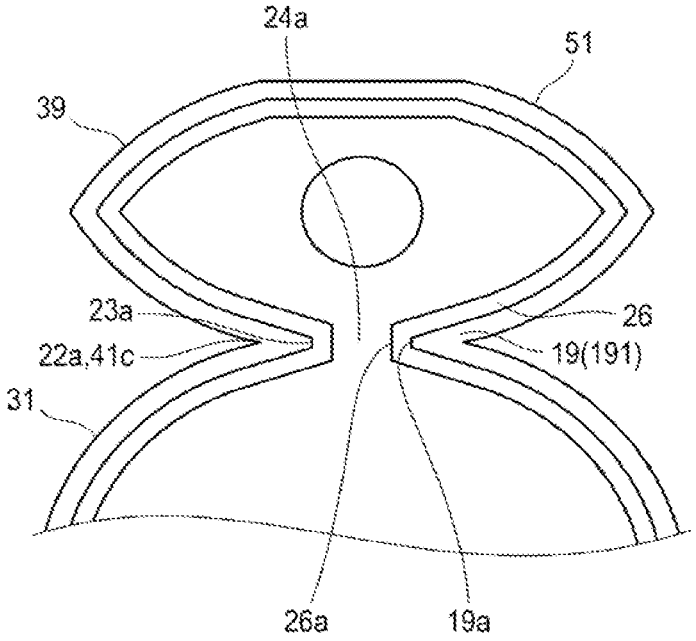
FIG. 22 is a partially enlarged view of a container forming sheet member for explaining a configuration of a sheet member container according to Modification 5.

Modification 5 illustrated in FIG. 22 is different from Modification 4 illustrated in FIG. 21 in that the non-sealing portion 111 is not provided, and in other points, this modification is similar to Modification 4.

Second Exemplary Embodiment

Next, a second exemplary embodiment will be described with reference to FIG. 13 to FIG. 15.

A sheet member container 100 according to this exemplary embodiment is different from the sheet member container 100 according to the above first exemplary embodiment in terms of points described below. In other points, the container is configured similarly to the sheet member container 100 according to the above first exemplary embodiment.

Figure 13:
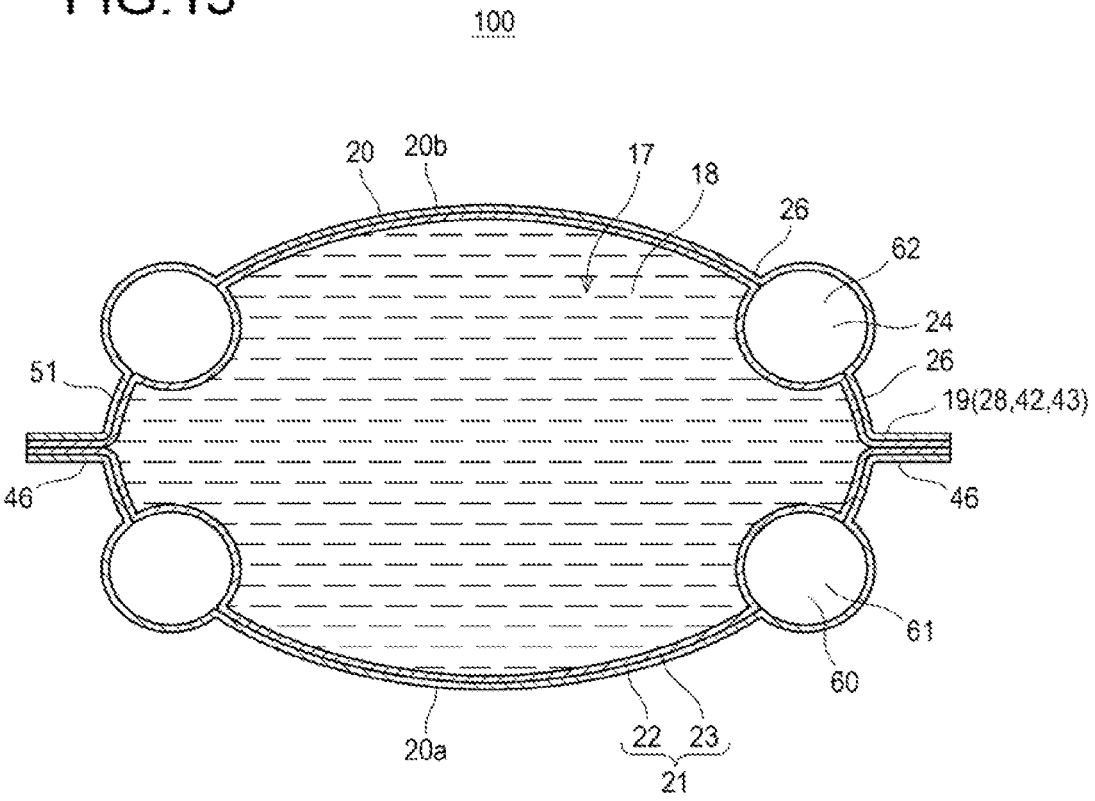
FIG. 13 is a flat cross-sectional view illustrating a state where a filler is enclosed in a sheet member container according to a second exemplary embodiment.
Figure 14:
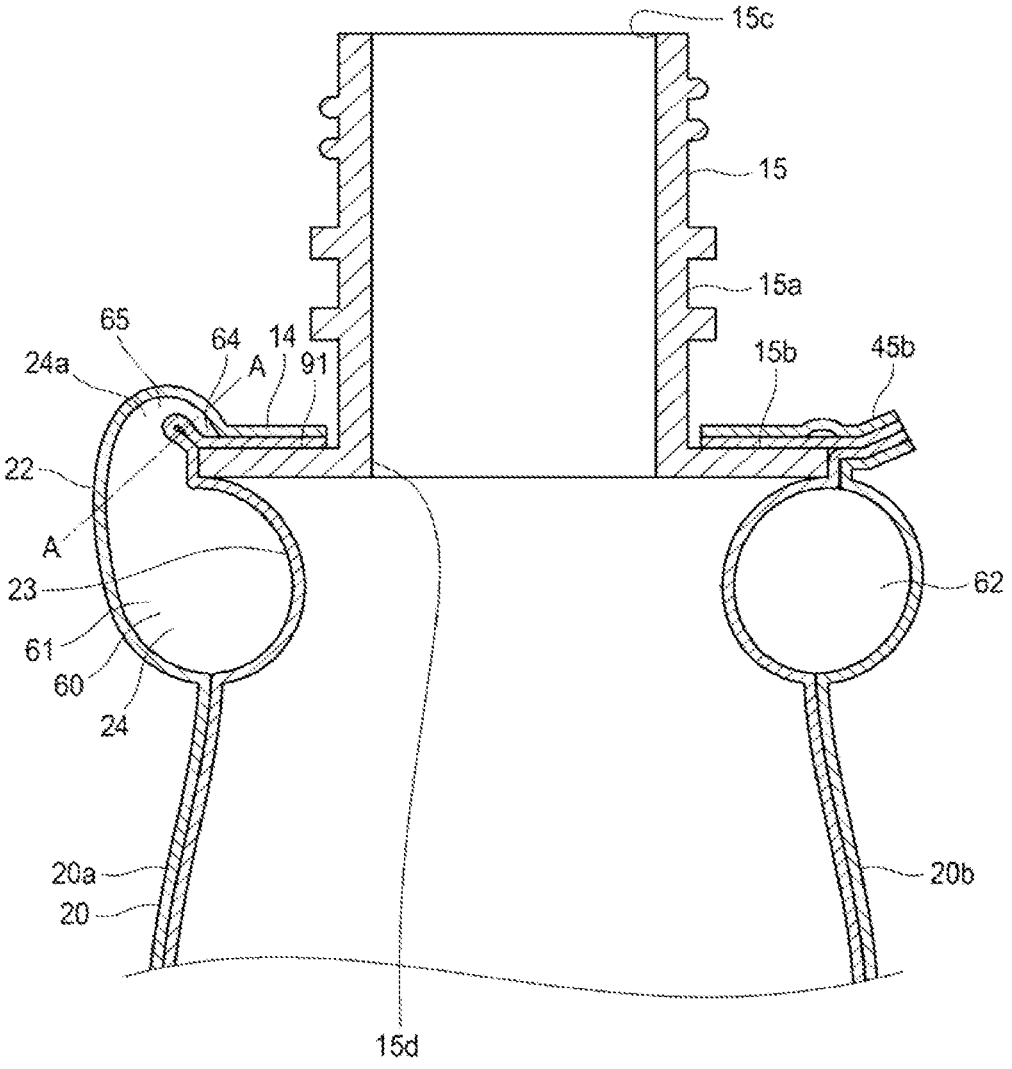
FIG. 14 is a side cross-sectional view illustrating a state where the filler is enclosed in the sheet member container according to the second exemplary embodiment.

As illustrated in FIG. 13 and FIG. 14, in a case of this exemplary embodiment, the sheet member container 100 does not include an inner bag 40. Then, a container main body 20 constitutes a containing portion 17. That is, in a peripheral edge sealing portion 19, portions of an inner film layer 23 of a main-body forming sheet member 21 are attached to each other. Consequently, the container main body 20 is formed, and the containing portion 17 is constituted.

Figure 15:
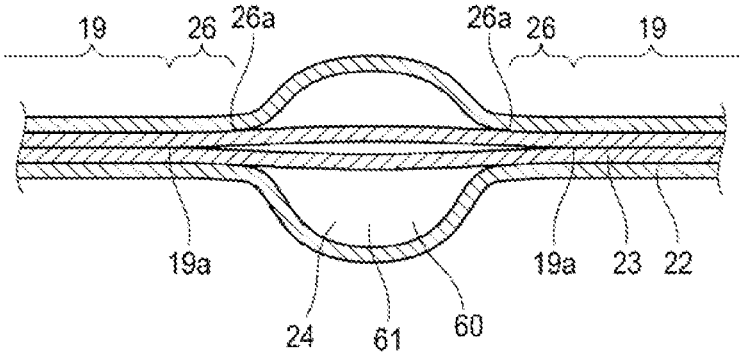
FIG. 15 is a cross-sectional view taken along the A-A line in FIG. 14.

Also, in the case of this exemplary embodiment, in a boundary between a first surface portion (first main surface portion 20*a*) and a second surface portion (top gusset portion 14), an end portion of the peripheral edge sealing portion along a folding line is away from a boundary position between an interfacial connecting portion and a main-body sealing portion as illustrated in FIG. 15.

Consequently, as illustrated in FIG. 14, in the case of this exemplary embodiment, an end portion 19*a* of the peripheral edge sealing portion 19 is also away from an interfacial connecting portion 65, and hence movement of an outer film layer 22 and the inner film layer 23 that constitute the interfacial connecting portion 65 is hard to be regulated. Thus, when a filling portion is filled with a filler in a folded state along the folding line, the filler can easily flow between a filling portion 60 of the first surface portion and the filling portion 60 of the second surface portion. For example, a first filling portion 61 to a fourth filling portion 64 can be favorably filled with a filler through the interfacial connecting portion 65.

Third Exemplary Embodiment

Next, a third exemplary embodiment will be described with reference to FIG. 16 and FIG. 17.

A sheet member container 100 according to this exemplary embodiment is different from the sheet member container 100 according to the above first exemplary embodiment in terms of points described below. In other points, the sheet member container 100 according to this exemplary embodiment is configured similarly to the sheet member container 100 according to the above first exemplary embodiment.

Figure 16:
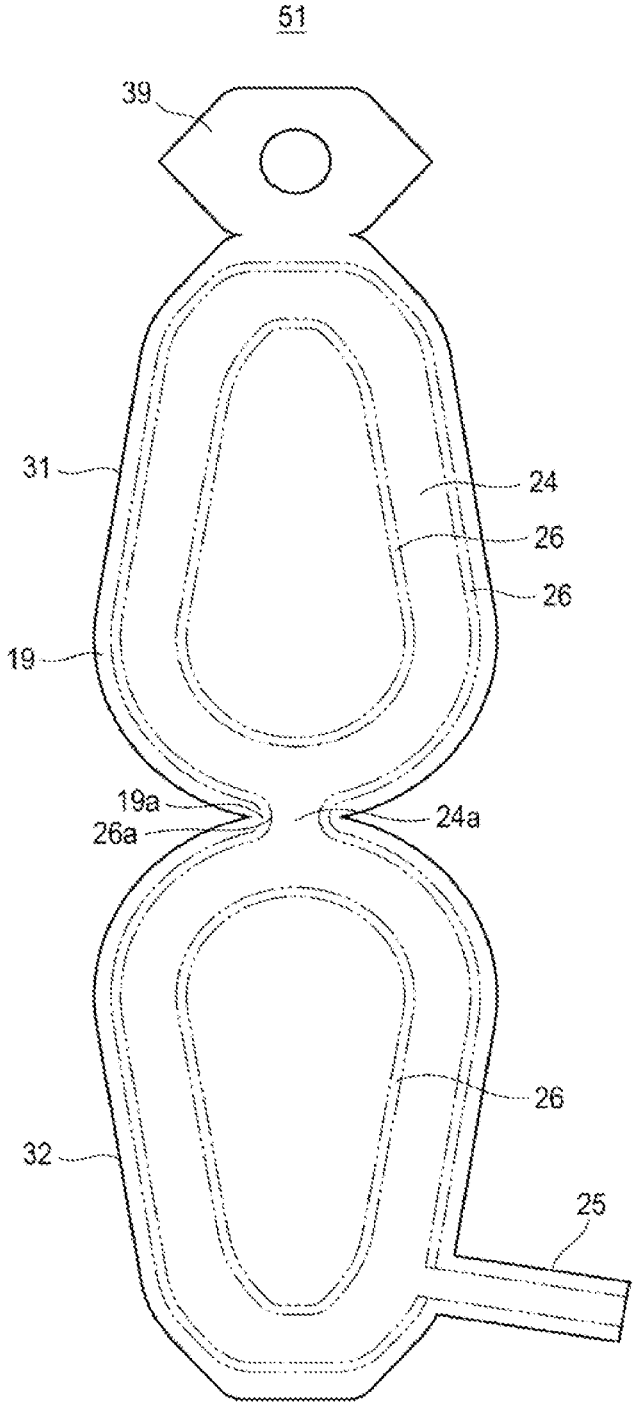
FIG. 16 is a plane view of a container forming sheet member that constitutes a sheet member container according to a third exemplary embodiment.

As illustrated in FIG. 16, in a case of this exemplary embodiment, a container forming sheet member 51 that constitutes the sheet member container 100 includes a first sheet portion 31 that forms a first main surface portion 20*a*, a second sheet portion 32 that forms a second main surface portion 20*b*, and a top-gusset forming sheet portion 39 that forms a top gusset portion 14, but the member does not include a bottom-gusset forming sheet portion 38 (see FIG. 10) that forms a bottom gusset portion 13. In the case of this exemplary embodiment, a connecting portion 24*a* of a non-attached region 24 is arranged only in a boundary between the first sheet portion 31 and the second sheet portion 32.

Figure 17:
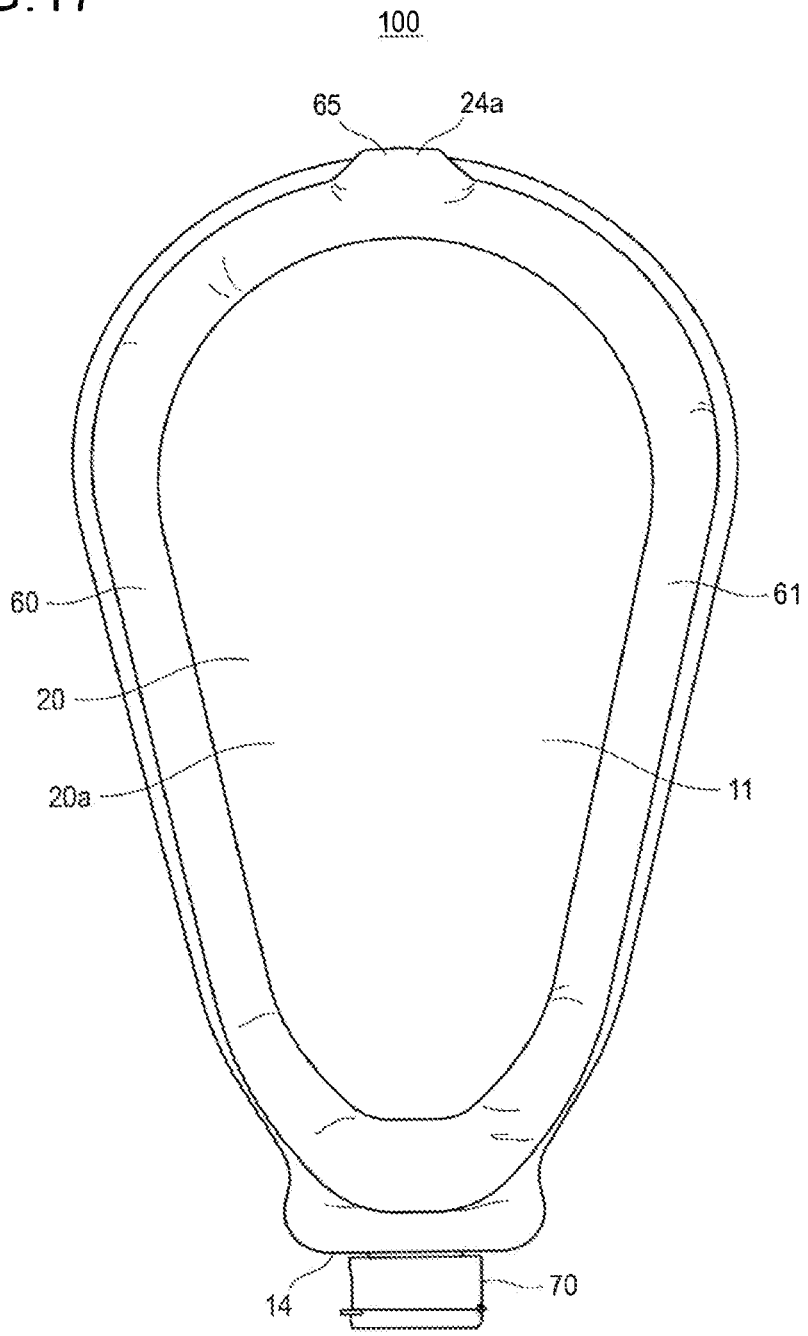
FIG. 17 is a plane view illustrating a state where a filler is enclosed in the sheet member container according to the third exemplary embodiment.
Figure 18:
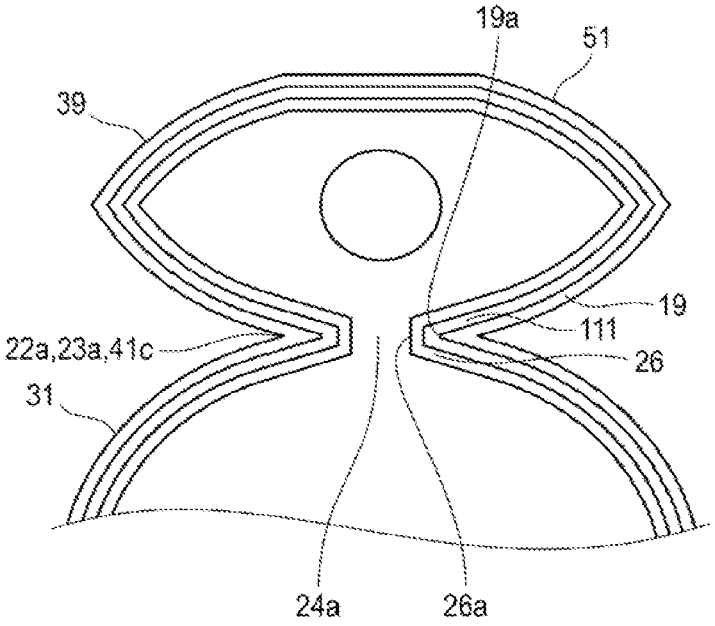
FIG. 18 is a partially enlarged view of a container forming sheet member for explaining a configuration of a sheet member container according to Modification 1.

Consequently, as illustrated in FIG. 17, the sheet member container 100 according to this exemplary embodiment includes a configuration that does not include the bottom gusset portion 13 and in which the first main surface portion 20*a* of a body portion 11 is directly connected to the second main surface portion 20*b* (not shown in the drawings). Then, an interfacial connecting portion 65 is arranged in a boundary between the first main surface portion 20*a* and the second main surface portion 20*b*, and a first filling portion 61 in the first main surface portion 20*a* is connected to a second filling portion 62 in the second main surface portion 20*b* via the interfacial connecting portion 65.

That is, in the case of this exemplary embodiment, a container main body 20 includes the body portion 11. One main surface portion (first main surface portion 20*a*) of the body portion 11 is a first surface portion, and the other main surface portion (second main surface portion 20*b*) of the body portion 11 is a second surface portion.

More specifically, in the case of this exemplary embodiment, a filling portion 60 includes the first filling portion 61 formed along a peripheral edge portion of the one main surface portion (first main surface portion 20*a*), and the second filling portion 62 formed along a peripheral edge portion of the other main surface portion (second main surface portion 20*b*). The first filling portion 61 is connected to the second filling portion 62 via the interfacial connecting portion 65.

Furthermore, a cap portion 70 is a screw cap that does not include a pump portion 72, a support cylinder portion 74, a head portion 73 or a nozzle portion 75 and that includes an opening/closing lid.

The sheet member container 100 may independently stand with a discharge port in a downward posture (inverted posture), or may be arranged with the body portion 11 lying on a mounting surface.

Also, in the case of this exemplary embodiment, in the boundary between the first surface portion (first main surface portion 20*a*) and the second surface portion (second main surface portion 20*b*), an end portion of a peripheral edge sealing portion along a folding line is away from a boundary position between the interfacial connecting portion 65 and a main-body sealing portion, and hence movement of an outer film layer 22 and an inner film layer 23 that constitute the interfacial connecting portion 65 is hard to be regulated.

Consequently, when a filling portion is filled with a filler in a folded state along the folding line, the first filling portion 61 to a fourth filling portion 64 can be favorably filled with the filler through the interfacial connecting portion 65.

The present invention is not limited to the above-described exemplary embodiments. Various modes such as changes and modifications are also included as long as the object of the present invention is achieved.

Alternatively, various constituent components of the sheet member container 100 do not have to exist individually and independently. For example, it is allowed that a plurality of constituent components are formed as a member, a constituent component is formed of a plurality of members, a certain constituent component is part of another constituent component, or part of the certain constituent component overlaps with part of the other constituent component.

EXPLANATION OF REFERENCE CHARACTERS

11 body portion
13 bottom gusset portion
14 top gusset portion
15 spout member
15*a* outlet cylinder portion
15*b* plate shape portion
15*c* and 15*d* opening
17 containing portion
18 contents
19 peripheral edge sealing portion
191 four-layer sealing portion
192 six-layer sealing portion
19*a* end portion
20 container main body
20*a* first main surface portion
20*b* second main surface portion
21 main-body forming sheet member
22 outer film layer
22*a* outer edge
23 inner film layer
23*a* outer edge
24 non-attached region
26 main-body sealing portion
26*a* boundary position
28 main-body peripheral edge sealing portion
41 inner-bag forming sheet member 41
41*c* outer edge
51 container forming sheet member
60 filling portion
61 first filling portion
62 second filling portion
63 third filling portion
64 fourth filling portion
81, 82, 83, 84, 85, and 86 folding line
91 attached portion
100 sheet member container
111 non-sealing portion

The invention claimed is:

1. A sheet member container, comprising:

one or more sheet members including a main-body forming sheet member including an outer film layer and an inner film layer laminated on each other;

a containing portion that accommodates contents;

a container main body including the main-body forming sheet member, and surrounding the containing portion, wherein the main-body forming sheet member includes a main-body sealing portion that is an attached portion of the outer film layer and the inner film layer, a non-attached region in which the outer film layer and the inner film layer are partially not attached, and a filling portion in which a filler is optionally enclosed between the outer film layer and the inner film layer in the non-attached region; and a peripheral edge sealing portion in which the one or more sheet members are folded along a folding line, and portions of a peripheral edge portion of at least an innermost layer sheet member of the one or more sheet members are attached to each other, wherein:

the containing portion is defined by the peripheral edge sealing portion, the container main body comprises a plurality of surface portions, the plurality of surface portions include a first surface portion and a second surface portion adjacent to each other, the filling portion includes an interfacial connecting portion arranged across the first surface portion and the second surface portion via a boundary between the first surface portion and the second surface portion, and in the boundary, an end portion of the peripheral edge sealing portion along the folding line is away from a boundary position between the interfacial connecting portion and the main-body sealing portion.

2. The sheet member container according to claim 1, wherein in the boundary, a width size of the peripheral edge sealing portion along the folding line is equal to or larger than a width size of the main-body sealing portion.

3. The sheet member container according to claim 1, wherein in the boundary, a width size of the peripheral edge sealing portion along the folding line is larger than a width size of the main-body sealing portion.

4. The sheet member container according to claim 1, wherein in the boundary, a total value of a width size of the peripheral edge sealing portion along the folding line and a width size of the main-body sealing portion is larger than a half of a width size of the interfacial connecting portion.

5. The sheet member container according to claim 1, wherein in the boundary, the main-body sealing portion is adjacent to the peripheral edge sealing portion.

6. The sheet member container according to claim 1, wherein at a position of the interfacial connecting portion, none of the film layers that constitute the sheet member container are attached to each other.

7. The sheet member container according to claim 1, wherein in the peripheral edge sealing portion, all of the film layers that constitute the sheet member container are attached.

8. The sheet member container according to claim 1, wherein the second surface portion includes a discharge port through which the contents are discharged from the containing portion.

9. The sheet member container according to claim 8, wherein:

the second surface portion includes a plate shape portion including an opening that communicates to the discharge port, and the one or more sheet members are attached to the plate shape portion.

10. The sheet member container according to claim 1, wherein:

the container main body includes a body portion and a top portion, a main surface portion of the body portion is the first surface portion, and the top portion is the second surface portion.

11. The sheet member container according to claim 10, wherein:

the top portion includes a discharge port through which the contents are discharged from the containing portion, the filling portion includes a first filling portion formed along a peripheral edge portion of the main surface portion, and a fourth filling portion formed around the discharge port in the top portion, and the first filling portion is connected to the fourth filling portion via the interfacial connecting portion.

12. The sheet member container according to claim 1, wherein:

the container main body includes a body portion and a bottom portion, a main surface portion of the body portion is the first surface portion, and the bottom portion is the second surface portion.

13. The sheet member container according to claim 12, wherein:

the filling portion includes a first filling portion formed along a peripheral edge portion of the main surface portion, and a third filling portion formed along a peripheral edge portion of the bottom portion, and the first filling portion is connected to the third filling portion via the interfacial connecting portion.

14. The sheet member container according to claim 1, wherein:

the container main body includes a body portion, a main surface portion of the body portion is the first surface portion, and the other main surface portion of the body portion is the second surface portion.

15. The sheet member container according to claim 14, wherein:

the filling portion includes a first filling portion formed along a peripheral edge portion of the main surface portion, and a second filling portion formed along a peripheral edge portion of the other main surface portion, and the first filling portion is connected to the second filling portion via the interfacial connecting portion.

16. The sheet member container according to claim 1, further comprising:

an inner bag arranged inside of the container main body, wherein the inner bag comprises an inner-bag forming sheet member that is an innermost layer sheet member of the one or more sheet members.

17. The sheet member container according to claim 16, wherein in the boundary, an outer edge of the outer film layer, an outer edge of the inner film layer and an outer edge of the inner-bag forming sheet member align with one another.

18. The sheet member container according to claim 1, wherein in the boundary, an outer edge of the inner film layer is arranged on an inner side of an outer edge of the outer film layer.

19. The sheet member container according to claim 1, wherein the filling portion is narrowed in the interfacial connecting portion.

20. The sheet member container according to claim 1, wherein a filler is enclosed in the filling portion.

* * * * *